US005393655A

United States Patent [19]

Sasaki et al.

[11] Patent Number: 5,393,655

[45] Date of Patent: Feb. 28, 1995

[54] SILVER HALIDE PHOTOGRAPHIC MATERIAL CONTAINING SELENIUM OR TELLURIUM COMPOUND

[75] Inventors: Hirotomo Sasaki; Hiroyuki Mifune; Toru Fujimori, all of Kanagawa, Japan

[73] Assignee: Fuji Photo Film Co., Ltd., Kanagawa, Japan

[21] Appl. No.: 161,275

[22] Filed: Dec. 3, 1993

[30] Foreign Application Priority Data

Dec. 10, 1992 [JP] Japan ..... 4-330495
Dec. 14, 1992 [JP] Japan ..... 4-333030

[51] Int. Cl.[6] ..... G03C 1/09

[52] U.S. Cl. ..... 430/603; 430/600; 430/601; 430/610; 430/611; 430/613; 430/614

[58] Field of Search ..... 430/600, 601, 603, 610, 430/613, 614, 611

[56] References Cited

U.S. PATENT DOCUMENTS 3,297,447 1/1967 McVeigh ..... 430/603
4,111,697 9/1975 Pollet et al. ..... 430/611
4,782,013 11/1988 Herz et al. ..... 430/564

*Primary Examiner*—Thorl Chea
*Attorney, Agent, or Firm*—Sughrue, Mion, Zinn, Macpeak & Seas

[57] ABSTRACT

A silver halide photographic material comprises a silver halide emulsion layer provided on a support. The silver halide emulsion layer contains a heterocyclic selenium or tellurium compound represented by the formula (Ia), (Ib), (Ic) or (Id):

(Ia)

(Ib)

(Ic)

(Id)

in which each of $Ch^1$, $Ch^3$, $Ch^6$ and $Ch^{12}$ is Se or Te; and each of $Ch^2$, $Ch^4$, $Ch^5$, $Ch^7$, $Ch^8$, $Ch^9$, $Ch^{10}$, $Ch^{11}$, $Ch^{13}$, $Ch^{14}$ and $Ch^{15}$ is O, S, Se or Te. Other selenium or tellurium compounds are also disclosed.

35 Claims, No Drawings

SILVER HALIDE PHOTOGRAPHIC MATERIAL CONTAINING SELENIUM OR TELLURIUM COMPOUND

FIELD OF THE INVENTION

The present invention relates to a silver halide photographic material. The invention more particularly relates to a silver halide photographic material containing a new selenium or tellurium compound in a silver halide emulsion layer.

BACKGROUND OF THE INVENTION

A photographic material comprises a silver halide emulsion provided on a support. The silver halide emulsion is usually chemically sensitized with various chemical sensitizers to obtain a desired sensitivity or gradation. Examples of the chemical sensitizers include a chalcogen (sulfur, selenium or tellurium) sensitizer, a noble metal (such as gold) sensitizer, a reduction sensitizer and a combination thereof.

An improvement of the silver halide photographic material has increasingly been demanded for several years. The recent photographic material requires very high sensitivity. Further, the photographic image requires an improvement of the graininess and the sharpness. A rapid image forming process such as a quick development process is also necessary. The sensitization and the sensitizers have been improved to meet these requirements.

Sulfur sensitization has most frequently been used in the silver halide photography. Numerous sulfur sensitizers have been known and used in silver halide photographic materials.

On the other hand, selenium or tellurium sensitization is more effective than the sulfur sensitization. Accordingly, selenium or tellurium sensitizers have been proposed in place of the sulfur sensitizers. However, the proposed sensitizers have a tendency that fogs easily occur in the image and gradation of the image is softened. Therefore, the sensitizers should be further improved to be used in place of the conventional sulfur sensitizers.

U.S. Pat. No. 3,297,447 discloses selenourea derivatives (e.g., dimethylselenourea) as improved selenium sensitizers. However, the improvement is still insufficient, and a rather dense fog is observed in the image (as is shown in Tables in Examples of the present specification).

The above-mentioned chalcogen sensitization is usually used in combination with a gold sensitization. The combinations of the sensitizations remarkably improve the sensitivity of the photographic material. However, the combinations also increase the degree of fog in the image. The fog in gold-selenium or gold-tellurium sensitization is more remarkable than that in gold-sulfur sensitization. Accordingly, the fog caused by a selenium or tellurium sensitizer should be reduced particularly in the case that the selenium or tellurium sensitizer is used in combination with a gold sensitizer.

By the way, chalcogen compounds have also been used as silver halide solvents, silver halide ripening agents, antifogging agents or stabilizers. For example, U.S. Pat. Nos. 4,111,697 (Pollet et al), 4,782,013 (Herz et al) and Japanese Patent Provisional Publication No. 3(1991)-91735 disclose selenium or tellurium compounds. The disclosed compounds are effective as silver halide solvents, silver halide ripening agents, antifogging agents or stabilizers, but are not available as chalcogen sensitizers.

SUMMARY OF THE INVENTION

An object of the present invention is to provide a silver halide photographic material of high sensitivity, which is almost free from fog.

The present invention provides a silver halide photographic material comprising a silver halide emulsion layer provided on a support, wherein the silver halide emulsion layer contains a heterocyclic selenium or tellurium compound represented by the following formulas.

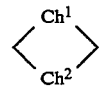

(Ia)

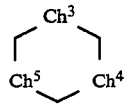

(Ib)

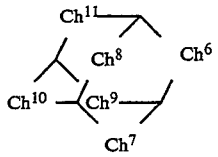

(Ic)

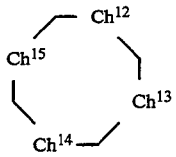

(Id)

in which each of $Ch^1$, $Ch^3$, $Ch^6$ and $Ch^{12}$ independently is Se or Te; each of $Ch^2$, $Ch^4$, $Ch^5$, $Ch^7$, $Ch^8$, $Ch^9$, $Ch^{10}$, $Ch^{11}$, $Ch^{13}$, $Ch^{14}$ and $Ch^{15}$ independently is O, S, Se or Te; the heterocyclic compound may have one or more substituent groups; and when the compound has two or more substituent groups, any two of the groups may be combined with each other to form a condensed heterocyclic ring.

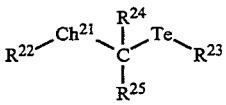

(II)

in which $Ch^{21}$ is O, S or Se; each of $R^{22}$ and $R^{23}$ independently is an aliphatic group, an aromatic group or a heterocyclic group; each of $R^{24}$ and $R^{25}$ independently is hydrogen, an aliphatic group, an aromatic group, a heterocyclic group, a halogen atom, cyano, nitro, sulfo, sulfino, carboxyl, phosphono, amino, an ammonio group, a phosphonio group, hydrazino, $—Ch^{26}R^{27}$ an acyl group, carbamoyl, an amido group, sulfamoyl, a sulfonamido group, an aliphatic sulfonyl group, an aromatic sulfonyl group, an aliphatic sulfinyl group, an aromatic sulfinyl group, an alkoxycarbonyl group, an aryloxycarbonyl group, $—Ch^{28}COR^{29}$ an alkoxycarbonylamino group, an aryloxycarbonylamino group or an ureido group; each of $Ch^{26}$ and $Ch^{28}$ independently is O, S, Se or Te; each of $R^{27}$ and $R^{29}$ independently is hydrogen, an aliphatic group, an aromatic group or a heterocyclic group; each of $R^{22}$, $R^{23}$, $R^{24}$ and $R^{25}$ may have one or more substituent groups; and any two of $R^{22}$, $R^{23}$, $R^{24}$ and $R^{25}$ may be combined with each other to form a heterocyclic ring.

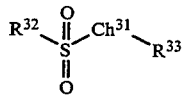
(IIIa)

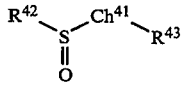
(IVa)

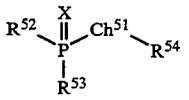
(Va)

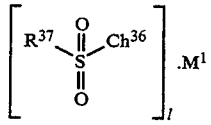
(IIIb)

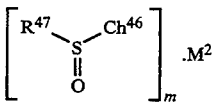
(IVb)

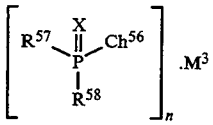
(Vb)

in which each of $Ch^{31}$, $Ch^{36}$, $Ch^{41}$, $Ch^{46}$, $Ch^{51}$ and $Ch^{56}$ independently is Se or Te; X is O or S; each of $R^{32}$, $R^{37}$, $R^{42}$, $R^{47}$, $R^{52}$, $R^{53}$, $R^{57}$ and $R^{58}$ independently is an aliphatic group, an aromatic group, a heterocyclic group, a halogen atom, amino or $—Ch^{61}R^{62}$; $Ch^{61}$ is O, S, Se or Te; $R^{62}$ is hydrogen, an aliphatic group, an aromatic group or a heterocyclic group; each of $R^{33}$, $R^{43}$ and $R^{54}$ independently is an aliphatic group, an aromatic group, a heterocyclic group, an acyl group, carbamoyl, sulfamoyl, an aliphatic sulfonyl group, an aromatic sulfonyl group, an aliphatic sulfinyl group, an aromatic sulfinyl group, an alkoxycarbonyl group or an aryloxycarbonyl group; each of $R^{32}$, $R^{33}$, $R^{37}$, $R^{42}$, $R^{43}$, $R^{47}$, $R^{52}$, $R^{53}$, $R^{54}$, $R^{57}$ and $R^{58}$ may have one or more substituent groups; $R^{52}$ and $R^{53}$ may be combined with each other to form a heterocyclic ring; $R^{57}$ and $R^{58}$ may be combined with each other to form a heterocyclic ring. $M^1$ is an 1-valent cation; $M^2$ is an m-valent cation; and $M^3$ is an n-valent cation.

The present invention also provides a silver halide photographic material comprising a silver halide emulsion layer provided on a support, wherein the silver halide emulsion is sensitized with a selenium or tellurium compound represented by the above-mentioned formulas.

The silver halide photographic material of the present invention contains a new selenium or tellurium compound represented by the above-mentioned formulas. The new compounds have a sufficient sensitizing effect, but do not increase the fog in the image. Therefore, the silver halide photographic material of the invention shows a high sensitivity, while the obtained image is almost free from fog.

DETAILED DESCRIPTION OF THE INVENTION

The formulas of the selenium and tellurium compounds are described below.

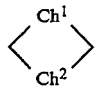
(Ia)

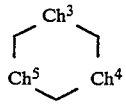
(Ib)

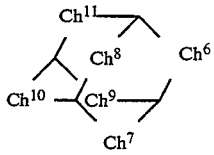
(Ic)

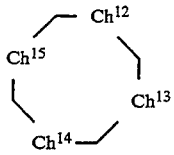
(Id)

Each of $Ch^1$, $Ch^3$, $Ch^6$ and $Ch^{12}$ independently is Se or Te, and preferably is Se.

Each of $Ch^2$, $Ch^4$, $Ch^5$, $Ch^7$, $Ch^8$, $Ch^9$, $Ch^{10}$, $Ch^{11}$, $Ch^{13}$, $Ch^{14}$ and $Ch^{15}$ independently is O, S, Se or Te, preferably is Se or Te, and more preferably is Se.

The heterocyclic rings may have one or more substituent groups. The substituent groups are preferably monovalent. Examples of the monovalent substituent groups include an aliphatic group, an aromatic group, a heterocyclic group, a halogen atom, cyano, nitro, sulfo, sulfino, carboxyl, phosphono, amino, an ammonio group, a phosphonio group, hydrazino, $—Ch^{16}R^{17}$, an acyl group, carbamoyl, an amido group, sulfamoyl, a sulfonamido group, an aliphatic sulfonyl group, an aromatic sulfonyl group, an aliphatic sulfinyl group, an aromatic sulfinyl group, an alkoxycarbonyl group, an aryloxycarbonyl group, $—Ch^{18}COR^{19}$, an alkoxycarbonylamino group, an aryloxycarbonylamino group and an ureido group. Each of $Ch^{16}$ and $Ch^{18}$ independently is O, S, Se or Te. Each of $R^{17}$ and $R^{19}$ independently is hydrogen, an aliphatic group, an aromatic group or a heterocyclic group. An aliphatic group, an aromatic group, a halogen atom, cyano, sulfo, amino, $—Ch^{16}R^{17}$, an acyl group, carbamoyl, an amido group, an alkoxycarbonyl group and $—Ch^{18}COR^{19}$ are preferred. An aliphatic group, an aromatic group and an acyl group are more preferred. An aliphatic group and an aromatic group are most preferred. An aliphatic group is particularly preferred. The substituent groups of the heterocyclic rings may be further substituted with another group. Any two of the substituent groups of the heterocyclic rings may be combined with each other to form a condensed heterocyclic ring.

The above-mentioned aliphatic groups include an alkyl group, an alkenyl group, an alkynyl group and an aralkyl group. The aliphatic group may have any of straight, branched and cyclic structures.

The alkyl group preferably has 1 to 30 carbon atoms, and more preferably has 1 to 20 carbon atoms. Examples of the alkyl groups include methyl, ethyl, n-propyl, isopropyl, t-butyl, n-octyl, n-decyl, n-hexadecyl, cyclopropyl, cyclopentyl and cyclohexyl.

The alkenyl group preferably has 2 to 30 carbon atoms, and more preferably has 2 to 20 carbon atoms. Examples of the alkenyl groups include allyl, 2-butenyl and 3-pentenyl.

The alkynyl group preferably has 2 to 30 carbon atoms, and more preferably has 2 to 20 carbon atoms. Examples of the alkynyl groups include propargyl and 3-pentynyl.

The aralkyl group preferably has 7 to 30 carbon atoms, and more preferably has 7 to 20 carbon atoms. Examples of the aralkyl groups include benzyl and phenethyl.

The aromatic group means an aryl group.

The aryl group preferably has 6 to 30 carbon atoms, and more preferably has 6 to 20 carbon atoms. Examples of the aryl groups include phenyl and naphthyl.

The heterocyclic group preferably has a three-membered to ten-membered heterocyclic ring, and more preferably has a five-membered or six-membered ring. The heterocyclic group preferably has an aromaticity. At least one hetero atom contained in the ring preferably is nitrogen, oxygen or sulfur. The heterocyclic group may be either saturated or unsaturated. The heterocyclic ring may be condensed with another heterocyclic ring or an aromatic ring. Examples of the heterocyclic groups include pyridyl, imidazolyl, quinolyl, benzimidazolyl, pyrimidyl, pyrazolyl, isoquinolyl, thiazolyl, thienyl, furyl and benzothiazolyl.

Examples of the substituted amino groups include methylamino, ethylamino, dimethylamino, diethylamino, anilino, o-toluidino and 2,4-xylidino.

Examples of the substituted ammonio groups include trimethylammonio and triethylammonio.

Examples of the substituted phosphonio groups include trimethylphosphonio and triethylphosphonio.

Examples of the substituted hydrazino groups include 2-methylhydrazino and 1-methylhydrazino.

Examples of the groups represented by $-Ch^{16}R^{17}$ include hydroxyl, mercapto, methoxy, ethoxy, isopropoxy, butoxy, phenoxy, benzyloxy, 2-naphthyloxy, 2-pyridyloxy, methylthio, ethylthio, phenylthio, methylseleno, ethylseleno, phenylseleno, methyltelluro, ethyltelluro and phenyltelluro.

Examples of the acyl groups include formyl, acetyl, propionyl, isobutyl, valeryl, pivaloyl, octanoyl, acryloyl, pyruvoyl, benzoyl, 1-naphthoyl, m-toluoyl and cinnamoyl.

Examples of the substituted carbamoyl groups include N-methylcarbamoyl, N-ethylcarbamoyl, N,N-dimethylcarbamoyl, N,N-diethylcarbamoyl and N-phenylcarbamoyl.

Examples of the amido groups include acetamido, benzamido, propionamido and pivalamido.

Examples of the substituted sulfamoyl groups include N-methylsulfamoyl, N-ethylsulfamoyl, N,N-dimethylsulfamoyl, N,N-diethylsulfamoyl and N-phenylsulfamoyl.

Examples of the sulfonamido groups include benzenesulfonamido and methanesulfoamido.

Examples of the aliphatic sulfonyl group include mesyl and tauryl.

An example of the aromatic sulfonyl group is tosyl.

An example of the aliphatic sulfinyl group is methanesulfinyl.

An example of the aromatic sulfinyl group is benzenesulfinyl.

Examples of the alkoxycarbonyl groups include methoxycarbonyl, ethoxycarbonyl, benzyloxycarbonyl and isopropoxycarbonyl.

Examples of the aryloxycarbonyl groups include phenoxycarbonyl and naphthyloxycarbonyl.

Examples of the groups represented by $-Ch^{1-8}COR^{19}$ include acetoxy, benzoyloxy, cyclohexylcarbonyloxy and acetylseleno.

An example of the alkoxycarbonylamino group is methoxycarbonylamino.

An example of the aryloxycarbonylamino group is phenoxycarbonylamino.

Examples of the ureido groups include N'-methylureido, N',N'-methylureido, N,N',N'-trimethylureido and N'-ethylureido, N'-phenylureido.

The substituent groups of the heterocyclic rings may further have one or more substituent groups. Examples of the substituent groups include a halogen atom (e.g., fluoride, chloride, isopropyl), an alkyl group (methyl, ethyl, n-propyl, isopropyl, t-butyl, n-octyl, cyclopentyl, cyclohexyl), an alkenyl group (e.g., allyl, 2-butenyl, 3-pentenyl), an alkynyl group (e.g., propargyl, 3-pentynyl), an aralkyl group (benzyl, phenethyl), an aryl group (e.g., phenyl, naphthyl, 4-methylphenyl), a heterocyclic group (e.g., pyridyl, furyl, imidazolyl, piperidyl, morpholino), an alkoxy group (e.g., methoxy, ethoxy, butoxy), an aryloxy group (e.g., phenoxy, 2-naphthyloxy), amino, a substituted amino group (e.g., dimethylamino, ethylamino, anilino), an amido group (e.g., acetamido, benzamido), ureido, a substituted ureido group (e.g., N-methylureido, N-phenylureido), an alkoxycarbonylamino group (e.g., methoxycarbonylamino), an aryloxycarbonylamino group (e.g., phenoxycarbonylamino), a sulfonamido group (e.g., methanesulfoamido, benzenesulfonamido), sulfamoyl, a substituted sulfamoyl group (e.g., N,N-dimethylsulfamoyl, N,N-diethylsulfamoyl, N-phenylsulfamoyl), carbamoyl, a substituted carbamoyl group (e.g., N,N-diethylcarbamoyl, N-phenylcarbamoyl), an aliphatic sulfonyl group (e.g., mesyl), an aromatic sulfonyl group (e.g., tosyl), an aliphatic sulfinyl group (e.g., methanesulfinyl), an aromatic sulfinyl group (e.g., benzenesulfinyl), an alkoxycarbonyl group (e.g., methoxycarbonyl, ethoxycarbonyl), an aryloxycarbonyl group (e.g., phenoxycarbonyl), an acyl group (e.g., acetyl, benzoyl, formyl, pivaloyl), an acyloxy group (e.g., acetoxy, benzoyloxy), a phosphoric amido (e.g., N,N-diethyl phosphoric amido), an arylthio group (e.g., phenylthio), cyano, sulfo, carboxyl, hydroxyl, mercapto, phosphono, nitro, sulfino, ammonio, a substituted ammonio group (e.g., trimethylammonio), phosphonio and hydrazino. Two or more substituent groups may be different from each other. The substituent groups may be furthermore substituted with another group.

When the heterocyclic compound has two or more substituent groups, any two of the groups may be combined with each other to form a condensed heterocyclic ring.

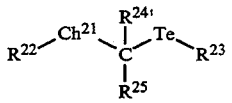

(II)

$Ch^{21}$ is O, S or Se, and preferably is S or Se.

Each of $R^{22}$ and $R^{23}$ independently is an aliphatic group, an aromatic group or a heterocyclic group, and preferably is an aliphatic group or a heterocyclic group.

Each of $R^{24}$ and $R^{25}$ independently is hydrogen, an aliphatic group, an aromatic group, a heterocyclic group, a halogen atom, cyano, nitro, sulfo, sulfino, carboxyl, phosphono, amino, an ammonio group, a phosphonio group, hydrazino, —$Ch^{26}R^{27}$, an acyl group, carbamoyl, an amido group, sulfamoyl, a sulfonamido group, an aliphatic sulfonyl group, an aromatic sulfonyl group, an aliphatic sulfinyl group, an aromatic sulfinyl group, an alkoxycarbonyl group, an aryloxycarbonyl group, —$Ch^{28}COR^{29}$, an alkoxycarbonylamino group, an aryloxycarbonylamino group or an ureido group. Each of $Ch^{26}$ and $Ch^{28}$ independently is O, S, Se or Te. Each of $R^{27}$ and $R^{29}$ independently is hydrogen, an aliphatic group, an aromatic group or a heterocyclic group. Hydrogen, an aliphatic group, an aromatic group, a halogen atom, cyano, sulfo, amino, —$Ch^{26}R^{27}$ an acyl group, carbamoyl, an amido group, an alkoxycarbonyl group and —$Ch^{28}COR^{29}$ are preferred. Hydrogen, an aliphatic group and an aromatic group are more preferred Each of $R^{22}$, $R^{23}$, $R^{24}$ and $R^{25}$ may have one or more substituent groups. Any two of $R^{22}$, $R^{23}$, $R^{24}$ and $R^{25}$ may be combined with each other to form a heterocyclic ring.

The definitions and the substituent groups of the above-mentioned groups are the same as those described in the formulas (Ia) to (Id).

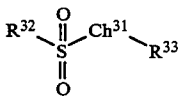

(IIIa)

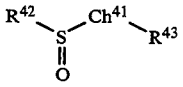

(IVa)

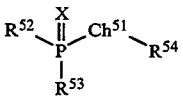

(Va)

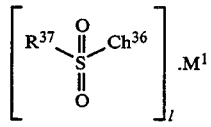

(IIIb)

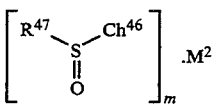

(IVb)

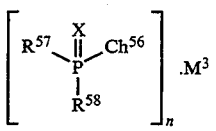

(Vb)

Each of $Ch^{31}$, $Ch^{36}$, $Ch^{41}$, $Ch^{46}$, $Ch^{51}$ and $Ch^{56}$ independently is Se or Te.

X is O or S.

Each of $R^{32}$, $R^{37}$, $R^{42}$, $R^{47}$, $R^{52}$, $R^{53}$, $R^{57}$ and $R^{58}$ independently is an aliphatic group, an aromatic group, a heterocyclic group, a halogen atom, amino or —$Ch^{61}R^{62}$. An aliphatic group, an aromatic group and a heterocyclic group are preferred. An aliphatic group and an aromatic group are more preferred. An aromatic group is most preferred. $Ch^{61}$ is O, S, Se or Te. $R^{62}$ is hydrogen, an aliphatic group, an aromatic group or a heterocyclic group.

Each of $R^{33}$, $R^{43}$ and $R^{54}$ independently is an aliphatic group, an aromatic group, a heterocyclic group, an acyl group, carbamoyl, sulfamoyl, an aliphatic sulfonyl group, an aromatic sulfonyl group, an aliphatic sulfinyl group, an aromatic sulfinyl group, an alkoxycarbonyl group or an aryloxycarbonyl group. An aliphatic group, a heterocyclic group, an acyl group, carbamoyl, sulfamoyl, an aliphatic sulfonyl group, an aromatic sulfonyl group, an alkoxycarbonyl group and an aryloxycarbonyl group are preferred. An acyl group, carbamoyl, sulfamoyl, an aliphatic sulfonyl group and an aromatic sulfonyl group are more preferred.

Each of $R^{32}$, $R^{33}$, $R^{37}$, $R^{42}$, $R^{43}$, $R^{47}$, $R^{52}$, $R^{53}$, $R^{54}$, $R^{57}$ and $R^{58}$ may have one or more substituent groups.

$R^{52}$ and $R^{53}$ may be combined with each other to form a heterocyclic ring; $R^{57}$ and $R^{58}$ may be combined with each other to form a heterocyclic ring.

$M^1$ is an 1-valent cation, $M^2$ is an m-valent cation, and $M^3$ is an n-valent cation. Each of 1, m and n preferably is 1, 2 or 3, more preferably is 1 or 2, and most preferably is 1. Namely, each of $M^1$, $M^2$ and $M^3$ most preferably is a monovalent cation. Examples of the monovalent cations include proton, an alkali metal ion (lithium, sodium, potassium, cesium) and an ammonium ion (e.g., tetramethylammonium).

The definitions and the substituent groups of the above-mentioned groups are the same as those described in the formulas (Ia) to (Id).

Examples of the selenium or tellurium compounds of the present invention are shown below.

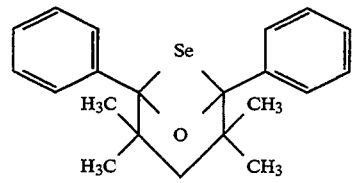

(Ia-1)

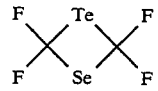

(Ia-2)

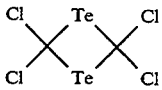

(Ia-3)

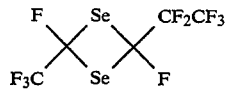

(Ia-4)

-continued
(Ia-5)
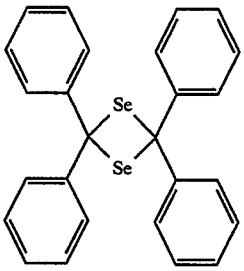
(Ia-6)
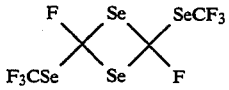
(Ia-7)
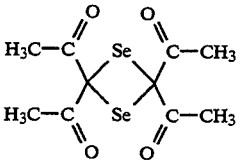
(Ia-8)
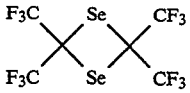
(Ia-9)
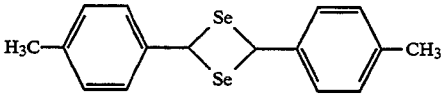
(Ia-10)
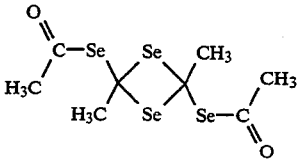
(Ia-11)
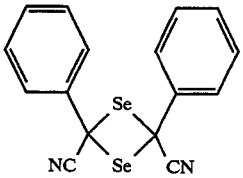
(Ia-12)
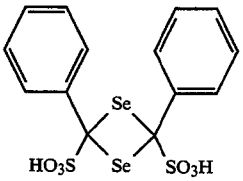
(Ia-13)
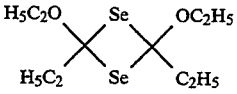
(Ia-14)
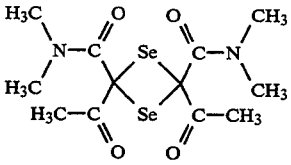
-continued
(Ia-15)
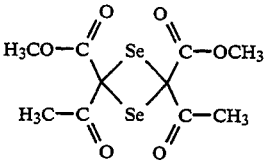
(Ib-1)
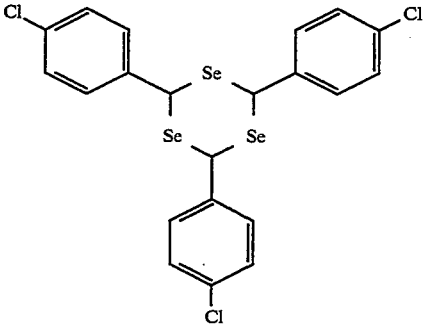
(Ib-2)
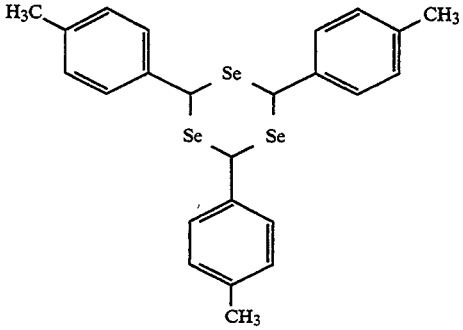
(Ib-3)
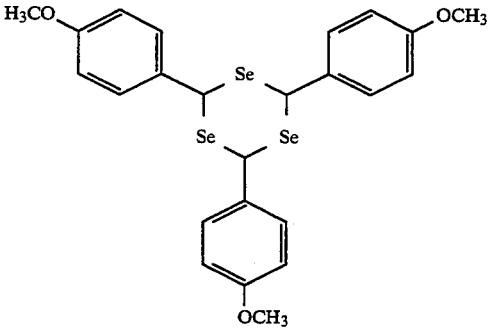
(Ib-4)
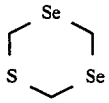
(Ib-5)
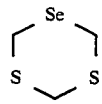

-continued
(Ib-6)
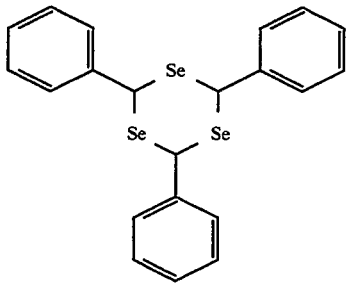
(Ib-7)
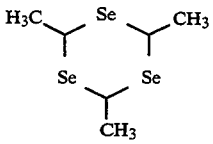
(Ib-8)
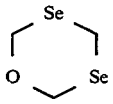
(Ib-9)
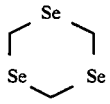
(Ib-10)
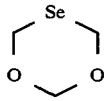
(Ib-11)
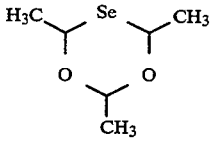
(Ic-1)
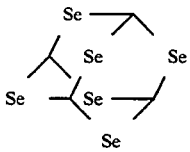
(Ic-2)
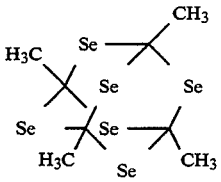
-continued
(Id-1)
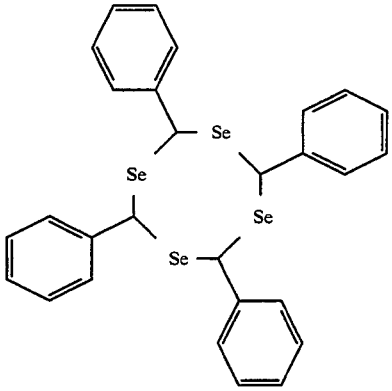
(II-1)
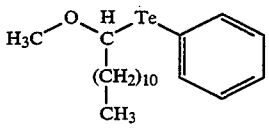
(II-2)
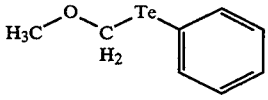
(II-3)
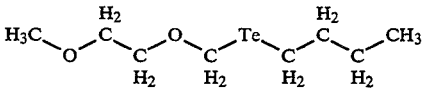
(II-4)
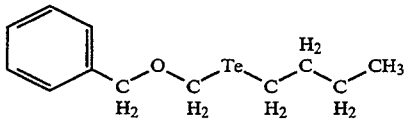
(II-5)
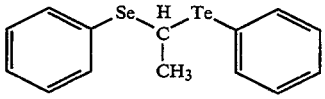
(II-6)
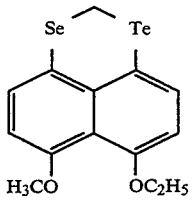
(II-7)
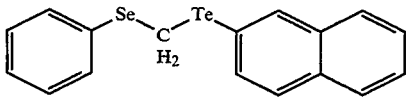
(II-8)
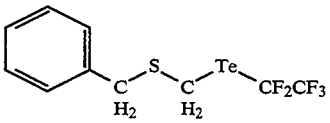
(II-9)
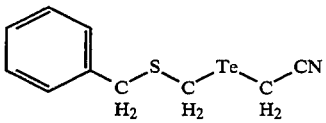

-continued
(II-10)
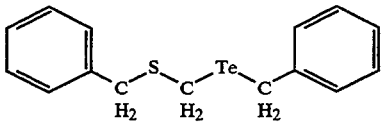
(IIIa-1)
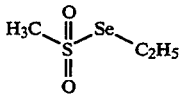
(IIIa-2)
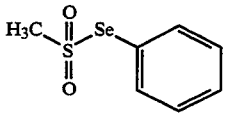
(IIIa-3)
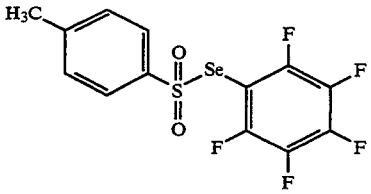
(IIIa-4)
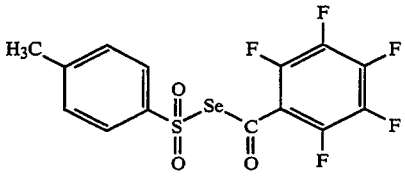
(IIIa-5)
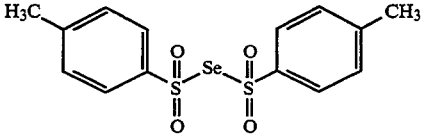
(IIIa-6)
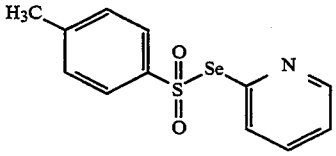
(IIIa-7)
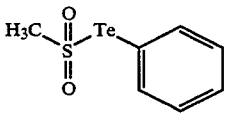
(IIIa-8)
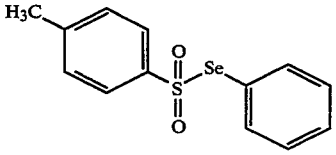
(IIIa-9)
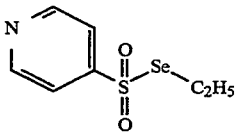
(IIIa-10)
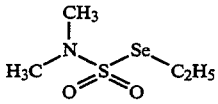
-continued
(IIIa-11)
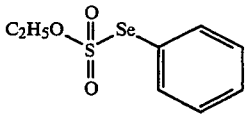
(IIIa-12)
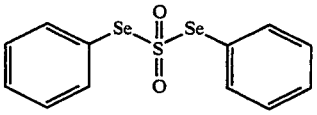
(IIIa-13)
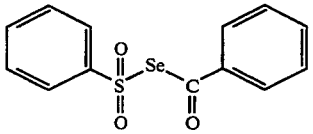
(IIIa-14)
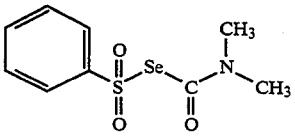
(IIIa-15)
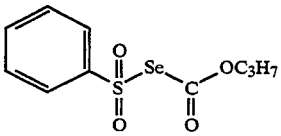
(IIIa-16)
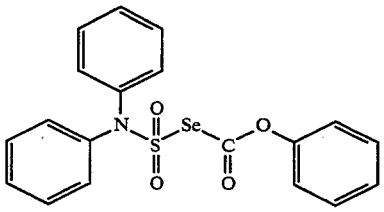
(IIIa-17)
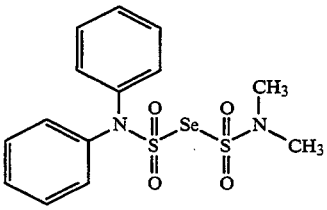
(IIIa-18)
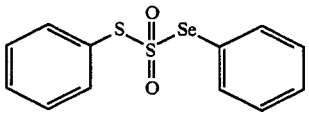
(IIIb-1)
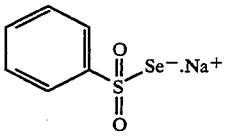
(IVa-1)
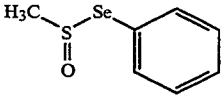

-continued
(IVa-2)
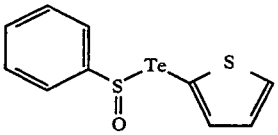
(IVa-3)
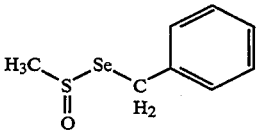
(IVa-4)
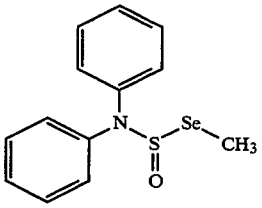
(IVa-5)
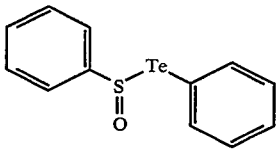
(IVb-1)
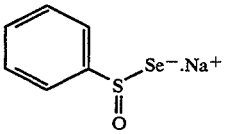
(Va-1)
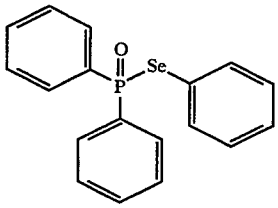
(Va-2)
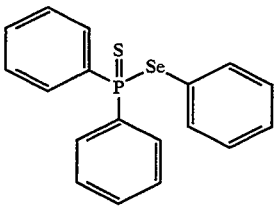
(Va-3)
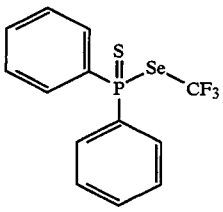
(Va-4)
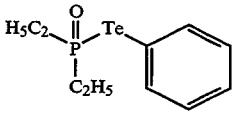
-continued
(Va-5)
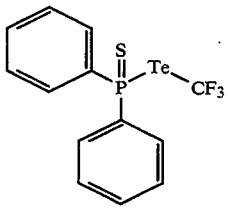
(Va-6)
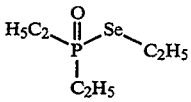
(Va-7)
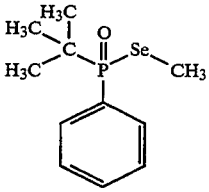
(Va-8)
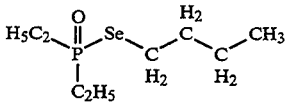
(Va-9)
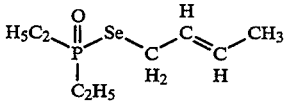
(Va-10)
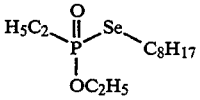
(Va-11)
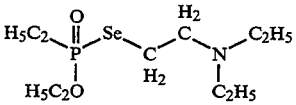
(Va-12)
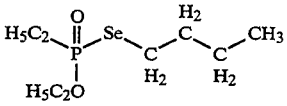
(Va-13)
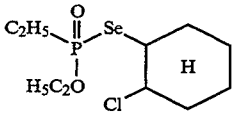
(Va-14)
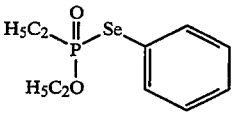
(Va-15)
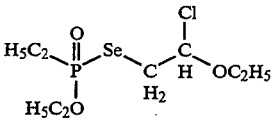
(Va-16)
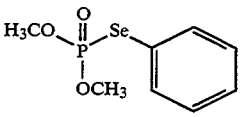

-continued (Va-17)

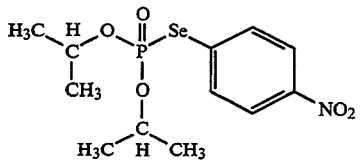

(Va-18)

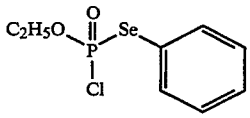

(Va-19)

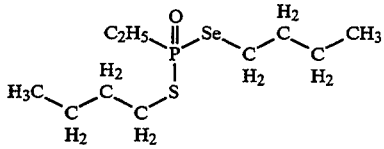

(Va-20)

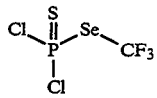

(Va-21)

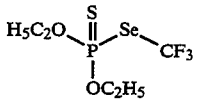

(Va-22)

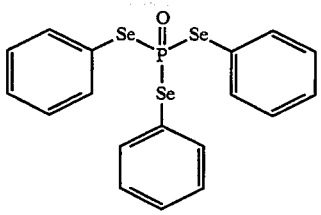

(Va-23)

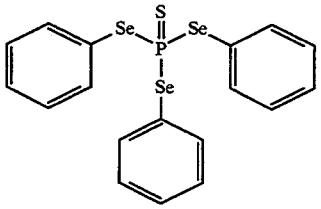

(Va-24)

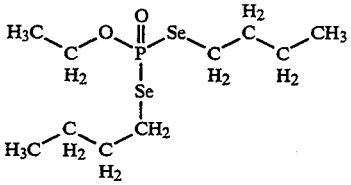

(Va-25)

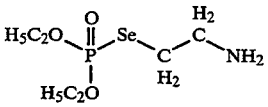

(Va-26)

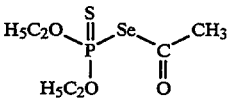

-continued (Va-27)

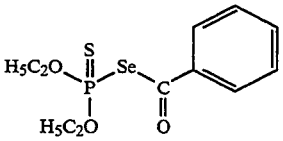

(Va-28)

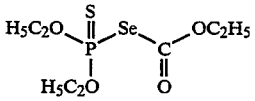

(Va-29)

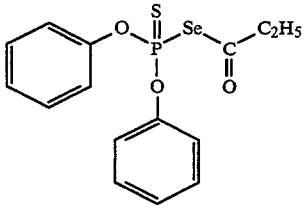

(Va-30)

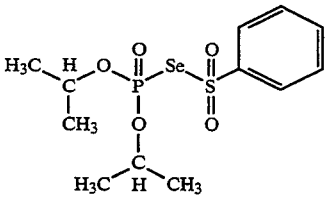

(Va-31)

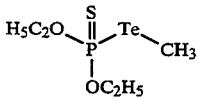

(Vb-1)

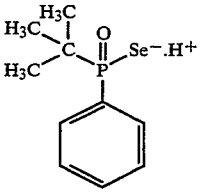

(Vb-2)

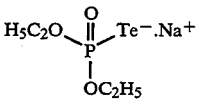

(Vb-3)

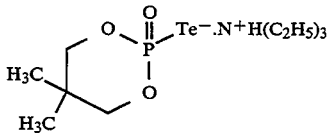

Synthesis examples are shown below. The other selenium or tellurium compounds can also be synthesized in a similar manner.

SYNTHESIS EXAMPLE 1

Synthesis of compound (Ib-5)

In atmosphere of argon, 4.7 g (21 mmol) of bis(trimethylsilyl)selenido was added to 20 ml (21 mmol) of dry dichloromethane solution of 2.:53 ml of anisaldehyde. To the mixture, 2.56 ml (21 mmol) of a complex of trifluoroboron with diethyl ether was added at 0° C. The mixture was stirred at 0° C. for 1 hour. To the reaction mixture, 100 ml of saturated aqueous solution of sodium hydrogencarbonate was added. The mixture was diluted with 100 ml of dichloromethane. The organic phase was dried with magnesium sulfate. The solvent was distilled away to obtain pale yellow crystals. The crystals were recrystallized from 80 ml of ethyl acetate and 30 ml of hexane. The subject compound (Ib-5) was obtained as needle-like white crystals. The melting point was 106 to 108° C. (decomposed). The yield was 2.32 g (56%). The subject compound was confirmed by a nuclear magnetic resonance spectrum, a mass spectrum, an infrared adsorption spectrum and an elemental analysis.

SYNTHESIS EXAMPLE 2

Synthesis of compound (Ia-7)

To a dry ether (140 ml) suspension of 14.3 g (65 mmol) of selenium tetrachloride, 40 ml of ether solution of 13.3 g (130 mmol) of acetylacetone was dropwise added. The mixture was stirred for 30 minutes at room temperature. The solvent was distilled away to obtain red oily substance. The substance was crystallized from hexane to obtain pale red crystals. The crystals were recrystallized from 140 ml of benzene. The subject compound (Ia-7) was obtained as white crystals. The melting point was 174° to 175° C. (decomposed). The yield was 1.9 g (8%). The subject compound was confirmed by a nuclear magnetic resonance spectrum, a mass spectrum, an infrared adsorption spectrum and an elemental analysis.

SYNTHESIS EXAMPLE 3

Synthesis of compound (IIIa-5)

To 100 ml of dry tetrahydrofuran (THF) solution of 17.8 g (0.10 mol) of sodium p-toluenesulfonate, 5.0 g (0.03 mol) of selenium oxychloride was dropwise added. The mixture was stirred for 10 hours at room temperature and for 4 hours at 60° C. White sedimentation was filtered off. THF was distilled away to obtain crude product as 11 g of white crystals. The crystals were recrystallized from 75 ml of hexane. The subject compound (IIIa-5) was obtained as white crystals. The melting point was 106° to 108° C. (decomposed). The yield was 4.1 g (35%). The subject compound was confirmed by a nuclear magnetic resonance spectrum, a mass spectrum, an infrared adsorption spectrum and an elemental analysis.

The reactions in the synthesis of the compounds are described in S. Patai, Z. Rappoport, The Chemistry of Organic Selenium and Tellurium compounds, volume 1 (1986) and volume 2 (1987); D. Liotta, Organoselenium Chemistry (1987); and K. J. Irgolic, The Organic Chemistry of Tellurium (1974).

Further, the reactions of the synthesis of the compounds of the formulas (Ia) to (Id) are described in Tetrahedron Lett., 30(44), 6047 (1989); phosphorus Sulfur, 4(2), 241 (1983); Z. Anorg. Allg. Chem., 488, 99–107 (1982); Z. Anorg. Allg. Chem., 488 60–68 (1982); J. Polym. Sci., Part B, 8(11), 749 (1970); Acta Chem. Scand., 23(9), 271 (1969); Chem. Commun., (8), 459 (1968); J. Macromol. Sci., Part A, 1(3), 387 (1967); J. Polym. Sci., Polym. Symp., No. 16, Pt. 3, 1521–7 (1967); J. Chem. Soc. B, (2), 117–18 (1967); Chimia, 46(3), 78 (1992); J. Chem. Soc., Chem. Commun., (1), 7 (1992); J. Chem. Soc., Chem. Commun., (19), 1378 (1991); J. Fluorine Chem., 53(1), 71 (1991); Z. Naturforsch., B. Chem. Sci., 46(2), 157 (1991); Chem. Ber., 124(1), 51 (1991); Angew. Chem., 102(9), 1082 (1990); J. Organomet. Chem., 359(1), 33 (1989); Chimia, 42(7/8), 265 (1988), J. Fluorine Chem., 32(4), 415 (1986); Z. Naturforsch., B. Anorg. Chem., Org. Chem., 35B(5), 526 (1980); J. Org. Chem., 45(17), 3517 (1980); Z. Anorg. Allg. Chem., 427(2), 114 (1976); J. Mol. Struct., 35(2), 253 (1976); Chem. -Ztg., 98(10), 511(1974); Zh. Vses. Khim. Obshchest., 17(2), 226 (1972); and Acta Chem. Scand., 23(9), 3271 (1969).

The reactions of the synthesis of the compounds of the formula (II) are described in Chem. Lett., (3), 415–18 (1991); Organometallics, 9(4), 1355–7 (1990); Synth. Met., 20(2), 161–7 (1987); J. Organomet. Chem., 277(2), 261–6 (1984); Quim. Nova, 6(3), 80–1 (1983); J. Chem. Res., Synop., (6), 146–7 (1983); and Zh. Org. Khim., 10(11), 2269–72 (1974).

The reactions of the synthesis of the compounds of the formulas (IIIa) to (Vb) are described in Chem. Ber., (101), 3070 (1968); Chem. Ber., (99), 1663 (1966); Angew. Chem., (77), 259 (1965); Pure Appl. Chem., (52), 959 (1980); Phosphorous, (3), 177 (1973); Zh. Obshch. Khim., (48), 1073 (1978); J. Med. Chem., (10), 115 (1967); Izv. Akad. Nauk SSSR, Ser. Khim., 1627 (1976); Izv. Akad. Nauk SSSR, Ser. Khim., 2635 (1977); Bull. Akad. Pol. Sci. Chem., (15), 153 (1967); Zh. Obshch. Khim., (38), 363 (1968); Zh. Obshch. Khim., (48), 331 (1978); Chem. Ber., (101), 3070 (1968); Helv. Chim. Acta, (59), 252 (1976); Zh. Obshch. Khim., (37), 495 (1967); J. Chem. Soc. Dalton Trans., 527 (1977); Bull. Akad. Pol. Sci., Ser. Sci. Chem., (21), 455 (1973); Acta Chem. Scand., (4), 1241 (1950); J. Chem. Soc. Chem. Commun., 658 (].977); and J. Chem. Soc. Chem. Commun., 693 (1985).

Two or more compounds of the present invention can be used in combination.

The amount of the selenium or tellurium compound for chemical sensitization depends on the nature of the compound, the nature of the silver halide grains and the conditions in the chemical sensitization. The amount of the selenium or tellurium sensitizer is usually in the range of $10^{-8}$ to $10^{-4}$ mol, and preferably in the range of $10^{-7}$ to $10^{-5}$ mol, based on I mol of silver halide.

The chemical sensitization using the sensitizer is conducted preferably at a pAg value of 6 to 11, and more preferably at a pAg value of 7 to 10, and most preferably at a pAg value of 7 to 9.5. The sensitization is preferably conducted at a pH of 3 to 10, and more preferably of 4 to 8. The temperature is preferably in the range of 40 to 95° C., and more preferably in the range of 50° to 85° C.

The selenium or tellurium compounds of the present invention can be used in combination with other known selenium or tellurium sensitizers. The known selenium or tellurium sensitizers are disclosed in U.S. Patent Nos. 1,574,944, 1,602,592, 1,623,499, 3,297,446, 3,297,447, 3,320,069, 3,408,196, 3,408,197, 3,442,653, 3,420,670, 3,531,289, 3,591,385, 3,655,394, 3,772,031, 4,704,349, 4,810,626; French Patents No. 2,093,038, 2,093,209; British Patents No. 235,211, 255,846, 861,984, 1,121,496; Canadian Patent No. 800,958; Japanese Patent Publications No. 52(1977)-34491, No. 52(1977)-34492, No. 52(1977)-36009, No. 52(1977)-38408, No. 53(1978)-295, No. 57(1982)-22090; Japanese Patent Provisional Publications No. 59(1984)-180536, No. 59(1984)-181337, No. 59(1984)-185329, No. 59(1984)-185330, No. 59(1984)-187338, No. 59(1984)-192241, No. 60(1985)-150046, No. 60(1985)-151637, No. 61(1986)-20940, No. 61(1986)-67845, No 61(1986)-246738, No. 63(1988)-292126; and H. E. Spencer et al, Journal of Photographic Science, Volume 31, pages 158 to 169, 1983.

A sulfur sensitization, a noble metal (e.g., gold) sensitization or a reduction sensitization can be used in combination with the selenium or tellurium sensitization. In the present invention, a gold sensitization is preferably used in combination with the selenium or tellurium sensitization.

In the noble metal sensitization, a salt of a noble metal (e.g., gold, platinum, palladium, iridium) is used. A gold compound is preferably used as the noble metal sensitizer. Examples of the gold sensitizers include chloroauric acid, potassium chloroaurate, potassium aurithiocyanate, gold sulfide and gold selenide. The noble metal sensitizer can be used in an amount of $10^{-7}$ to $10^{-2}$ mol based on 1 mol of silver halide.

In the sulfur sensitization, a labile sulfur compound is used. Examples of the sulfur sensitizers include thiosulfates (e.g., hypo), thioureas (e.g., diphenylthiourea, triethylthiourea, allylthiourea) and rhodanines. The sulfur sensitizers can be used in an amount of about $10^{-7}$ to $10^{-2}$ mol based on 1 mol of silver halide.

In the reduction sensitization, a reducing compound is used. Examples of the reducing compounds include stannous chloride, aminoiminomethanesulfinic acid, hydrazine compounds, borane compounds, silane compounds and polyamine compounds.

The selenium or tellurium sensitization is preferably conducted in the presence of a silver halide solvent. Examples of the silver halide solvents include thiocyanate salts (e.g., potassium thiocyanate), thioethers (e.g., 3,6-dithia-1,8-octanediol), tetra-substituted thiourea compounds (e.g., tetramethylthiourea), thion compounds, mercapto compounds, mesoionic compounds, selenoethers, telluroethers and sulfites. Ammonia, potassium rhodanide, ammonium rhodanide and amine compounds are also available as the silver halide solvent. The thiocyanate salt, the thioether, the tetra-substituted thiourea compound and the thion compound are preferred. The thiocyanate salt is particularly preferred. The thioethers are described in U.S. Pat. Nos. 3,021,215, 3,271,157, 3,574,628, 3,704,130, 4,276,374 and 4,297,439, Japanese Patent Publication No. 58(1983)-30571, and Japanese Patent Provisional Publication No. 60(1985)-136736. The tetra-substituted thiourea compounds are described in U.S. Pat. No. 4,221,863 and Japanese Patent Publication No. 59(1984)-11892. The thion compounds are described in Japanese Patent Publication No. 60(1985)-29727, and Japanese Patent Provisional Publications No. 53(1978)-144319, No. 53(1978)-82408 and No. 55(1980)-77737. The mercapto compounds are described in Japanese Patent Publication No. 63(1988)-29727. The mesoionic compounds are described in Japanese Patent Provisional Publication No. 60(1985)-163042. The selenoethers are described in U.S. Pat. No. 4,782,013. The telluroethers are described in Japanese Patent Provisional Publication No. 2(1990)-118566. The amine compounds are described in Japanese Patent Provisional Publication No. 54(1979)-100717. The silver halide solvent is preferably used in an amount of $10^{-5}$ to $10^{-2}$ mol based on 1 mol of silver halide.

The silver halide emulsion preferably is a silver bromide, silver iodobromide, silver iodochlorobromide, silver chlorobromide or silver chloride emulsion.

The shape of the silver halide grain may be either in the form of a regular crystal such as cube and octahedron or in the form of an irregular crystal such as globular shape and tabular shape. The shape of the grain may be complex of these crystals. A mixture of these crystals is also available. The regular crystal is particularly preferred.

The silver halide grains may have either a homogeneous structure or a heterogeneous structure in which halogen compositions inside and outside are different from each other. A latent image may be mainly formed either on surface of the grain (e.g., a negative emulsion) or inside the grain (e.g., an internal latent image emulsion or a prefogged direct reversal emulsion). The latent image is preferably formed on surface of the grain.

The silver halide emulsion preferably is a tabular grain emulsion in which tabular silver halide grains are contained in an amount of 50% or more based on the total projected area of all the grains. The tabular silver halide grains have a thickness of not more than 0.5 μm (preferably not more than 0.3 μm), a diameter of not less than 0.6 μm and a mean aspect ratio of not less than 5. Further, the silver halide emulsion preferably is a monodispersed emulsion, which has such an almost uniform grain size distribution that a statistic coefficient of variation is not more than 20%. The coefficient of variation (S per d) is determined by dividing a standard deviation (S) by a diameter (d), which is determined by approximating the projected area of the grain to a circle. A mixture of the tabular grain emulsion and the monodispersed emulsion is also available.

The silver halide emulsion can be prepared by conventional processes. The processes are described in P. Glafkides, Chimie er Physique Photographique (Paul Montel Co., 1967); G. F. Duffin, Photographic Emulsion Chemistry (Focal Press, 1966); and V. L. Zelikman et al, Making and Coating Photographic Emulsion (Focal Press, 1964).

The previously mentioned silver halide solvent can be used to control the grain growth in formation of the silver halide grains.

A salt can be added to the emulsion at the stage for formation of the silver halide grains or physical ripening thereof. Examples of the salts include a cadmium salt, a zinc salt, a thallium salt, an iridium salt (or its complex salt), a rhodium salt (or its complex salt) and an iron salt (or its complex salt).

A hydrophilic colloid is used as a binder or a protective colloid for the emulsion layer or an intermediate layer of the photographic material of the invention. Gelatin is an advantageous hydrophilic colloid. The other protective colloids such as proteins, saccharide derivatives and synthetic hydrophilic polymers are also available. Examples of the proteins include a gelatin derivative, a graft polymer of gelatin with another polymer, albumin and casein. Examples of the saccharide derivatives include a cellulose derivative (e.g., hydroxyethyl cellulose, carboxymethyl cellulose and cellulose sulfate), sodium alginate and a starch derivative. Examples of the synthetic hydrophilic homopolymers or copolymers include polyvinyl acetal, a partial acetal of polyvinyl alcohol, poly-N-vinylpyrrolidone, polyacrylic acid, polymethacrylic acid, polyacrylamide, polyvinyl imidazole and polyvinyl pyrazole.

Examples of gelatin used for the layers include general-purpose lime-processed gelatin, acid-processed gelatin and enzyme-processed gelatin. The enzyme-processed gelatin is described in Bull. Soc. Phot. Japan, No. 16, page 30 (1980). A hydrolysis product of gelatin is also available.

The hydrophilic colloidal layer (e.g., silver halide emulsion layer, a backing layer) of the photographic material can contain an inorganic or organic hardening agent. Examples of the hardening agents include a chromium salt, an aldehyde, an N-methylol compound, an active halogen compound, an active vinyl compound, an N-carbamoylpyridinium salt and a haloamidinium salt. Examples of the aldehydes include formaldehyde, glyoxal and glutaraldehyde. An example of the N-methylol compound is dimethylolurea. Examples of the active halogen compounds include 2,4-dichloro-6-hydroxy-1,3,5-triazine and sodium salt thereof. Examples of the active vinyl compounds include 1,3-bisvinylsulfonyl-2propanol, 1,2-bis(vinylsulfonylacetamide)ethane, bis(vinylsulfonylmethyl)ether and a vinyl polymer having vinylsulfonyl group on its side chain. An example of the N-carbamoylpyridinium salt is 1-morpholinocarbonyl-3-pyridinio)methanesulfonate. An example of the haloamidinium salt is 1-(1-chloro-1-pyrizino-methylene)pyrrolizinium 2-naphthalenesulfonate.

The active halogen compound, the active vinyl compound, the N-carbamoylpyridinium salt and the haloamidinium salt are preferred because they quickly harden the layers. The active halogen compound and the active vinyl compound are particularly preferred because they give a stable photographic property to the photographic material.

The silver halide emulsion can be spectrally sensitized with a sensitizing dye. Examples of the sensitizing dyes include a methine dye, a cyanine dye, a merocyanine dye, a complex cyanine dye, a complex merocyanine dye, a holopolar cyanine dye, a hemicyanine dye, a styryl dye and a hemioxonol dye. The cyanine dye, the merocyanine dye and the complex merocyanine dye are particularly preferred. These dyes have a basic heterocyclic ring, which is generally contained in the cyanine dyes. Examples of the ring include a pyrroline ring, an oxazoline ring, a thiazoline ring, a pyrrole ring, an oxazole ring, a thiazole ring, a selenazole ring, an imidazole ring, a tetrazole ring and a pyridine ring. Further, an alicyclic hydrocarbon ring or an aromatic hydrocarbon ring may be condensed with the above-described ring. Examples of the condensed ring include an indolenine ring, a benzindolenine ring, an indole ring, a benzoxazole ring, a naphthooxazole ring, a benzthiazole ring, a naphthothiazole ring, a benzserenazole ring, a benzimidazole ring and a quinoline ring. These rings may have a substituent group that is attached to the carbon atom of the rings.

The merocyanine dye or the complex merocyanine dye can contain a five-membered or six-membered heterocyclic ring having a ketomethylene structure. Examples of the heterocyclic rings include pyrazoline-5-one rings, thiohydantoin rings, 2-thiooxazolidine-2,4-dione rings, thiazolidine-2,4-dione rings, rhodanine rings and thiobarbituric acid rings.

Two or more sensitizing dyes can be used in combination. A combination of the sensitizing dyes is often used for supersensitization. In addition to the sensitizing dyes, a supersensitizer can be contained in the silver halide emulsion. The supersensitizer itself does not exhibit a spectral sensitization effect or does not substantially absorb visible light, but shows a supersensitizing activity. Examples of the supersensitizer include an aminostilbene compound substituted with a nitrogen-containing heterocyclic group, a condensate of an aromatic organic acid with formaldehyde, a cadmium salt, an azaindene compound and a combination thereof. A combination of the supersensitizers is particularly preferred. The aminostilbene compound is described in U.S. Pat. Nos. 2,933,390 and 3,635,721. The condensate of an aromatic organic acid and formaldehyde is described in U.S. Pat. No. 3,743,510. The combinations of the supersensitizers are described in U.S. Pat. Nos. 3,615,613, 3,615,641, 3,617,295 and No. 3,635,721.

The silver halide emulsion may contain an antifogging agent or a stabilizer. The antifogging agent prevents occurrence of a fog. The stabilizer has a function of stabilizing the photographic property. The antifogging agent and the stabilizer are used in preparation, storage or processing stage of the photographic material. The antifogging agents and stabilizers are azoles, mercaptopyrimidines, mercaptotriazines, thioketone compounds, azaindenes or amides. Examples of the azoles include benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles and mercaptotetrazoles (e.g., 1-phenyl-5-mercaptotetrazole). An example of the thioketone compound is oxazolinethione. Examples of the azaindenes include triazaindenes, tetrazaindenes (e.g., 4-hydroxy-substituted (1,3,3a,7)tetraazaindenes) and pentazaindenes. Examples of the amides include benzenethiosulfonic amide, benzenesulfinic amide and benzenesulfonic amide.

The photographic material may contain a surface active agent to improve various properties. For example, a coating property, an antistatic property, a slipping property, an emulsifying or dispersing property, an antitacking property and photographic properties (e.g., development acceleration, high contrast and sensitization) can be improved.

The hydrophilic colloidal layer of the photographic material may contain a water-soluble dye. The water-soluble dye has various functions such as a function of antiirradiation or a function of antihalation as well as a function as a filter dye. Examples of the dyes include an oxonol dye, a hemioxonol dye, a styryl dye, a merocyanine dye, an anthraquinone dye, an azo dye, a cyanine dye, an azomethine dye, a triarylmethane dye and a phthalocyanine dye. Further, an oil-soluble dye can be also added to the hydrophilic colloidal layer by emulsifying the dye in water by a known oil droplet dispersing method.

The photographic material can be used as a multi-layered multicolor photographic material. The multi-layered material comprises a support and two or more silver halide emulsion layers that have different spectral sensitivities.

The multi-layered color photographic material generally comprises at least one red-sensitive emulsion layer, at least one green-sensitive emulsion layer and at least one blue-sensitive emulsion layer on the support. The arrangement of those layers can optionally be determined. Preferably, the red-sensitive layer, the green-sensitive layer and the blue-sensitive layer are arranged from the support in the order. The blue-sensitive layer, the green-sensitive layer and the red-sensitive layer can be arranged in the order from the support. The blue-sensitive layer, the red-sensitive layer and the green-sensitive layer can also be arranged in the order from the support. Further, two or more emulsion layers that are sensitive to the same color but show different sensitivities can be provided to enhance the sensitivity. Three emulsion layers can be provided to improve the graininess of the image. A non-light sensitive layer may be provided between two or more emulsion layers having the same color sensitivity. Otherwise, another emulsion layer having a different color sensitivity can be provided between two or more emulsion layers having the same color sensitivity. A light-reflecting layer such as a layer of silver halide grains can be provided under a high sensitive layer, particularly under a high blue-sensitive layer, to enhance the sensitivity.

The red-sensitive emulsion layer generally contains a cyan coupler, the green-sensitive emulsion layer generally contains a magenta coupler, and the blue-sensitive emulsion layer generally contains a yellow coupler. However, other combinations are also available. For example, an infrared sensitive layer can be used to prepare a false color film or a film for exposure to a semiconductor laser beam.

Various color couplers can be used for the photographic material of the invention. The color couplers are described in the patents cited in Research Disclosure No. 17643, VII C-G.

Yellow couplers are described in U.S. Pat. Nos. 3,933,501, 4,022,620, 4,326,024 and No. 4,401,752, Japanese Patent Publication No. 58(1983)-10739, and British Patents No. 1,425,020 and No. 1,476,760.

Preferred magenta couplers are 5-pyrazolone type and pyrazoloazole type compounds. The magenta couplers are described in U.S. Pat. Nos. 4,310,619 and 4,351,897, European Patent No. 73,636, U.S. Pat. Nos. 3,061,432 and 3,725,067, Research Disclosure No. 24220 (June 1984), Japanese Patent Provisional Publication No. 60(1985)-33552, Research Disclosure No. 24230 (June 1984), Japanese Patent Provisional Publication No. 60(1985)-43659, and U.S. Pat. Nos. 4,500,630 and No. 4,540,654.

Preferred cyan couplers are phenol type and naphthol type couplers. The cyan couplers are described in U.S. Pat. Nos. 2,369,929, 2,772,162, 2,801,171, 2,895,826, 3,446,622, 3,758,308, 3,772,002, 4,052,212, 4,146,396, 4,228,233, 4,296,200, 4,327,173, 4,333,999, 4,334,011, 4,427,767, 4,451,559, German Patent Publication No. 3,329,729, European Patents No. 121,365A and No. 161,626A.

A colored coupler may be used to compensate incidental absorption of a formed dye. The colored couplers are described in Research Disclosure No. 17643, VII-G, U.S. Pat. No. 4,163,670, Japanese Patent Publication No. 57(1982)-39413, U.S. Pat. Nos. 4,004,929 and 4,138,258, and British Patent No. 1,146,368.

The photographic material can contain a coupler that gives a developed color dye having an appropriate diffusion property. Such couplers are described in U.S. Pat. No. 4,366,237. British Patent No. 2,125,570, European Patent No. 96,570 and German Patent Publication No. 3,234,533.

A polymerized dye-forming coupler is also available. The dye-forming couplers are described in U.S. Pat. Nos. 3,451,820, 4,080,211 and 4,367,282, and British Patent No. 2,102,173.

The photographic material can contain a coupler that releases a photographic functional residue according to a coupling reaction. For example, a DIR coupler releases a development inhibitor. The DIR couplers are described in Research Disclosure No. 17643, VII-F, Japanese Patent Provisional Publications No. 57(1982)-151944, No. 57(1982)-154234 and No. 60(1985)-184248, and U.S. Pat. No. 4,248,962.

The photographic material can also contain a coupler that imagewise releases a nucleating agent or a development accelerator in a development process. Such couplers are described in British Patents No. 2,097,140 and No. 2,131,188, and Japanese Patent Provisional Publications No. 59(1984)-157638 and No. 59(1984)-170840.

Examples of other couplers include a competitive coupler, a polyvalent coupler, a DIR redox compound, a DIR coupler releasing coupler, a dye releasing coupler, a bleach accelerator releasing coupler and a ligand releasing coupler. The competitive coupler is described in U.S. Pat. No. 4,130,427. The polyvalent coupler is described in U.S. Pat. Nos. 4,283,472, 4,338,393 and 4,310,618. The DIR redox compounds and the DIR coupler releasing couplers are described in Japanese Patent Provisional Publications No. 60(1985)-185950 and No. 62(1987)-24252. The dye releasing coupler releases a dye, which is restored to original color. The dye releasing coupler is described in European Patent No. 173,302A. The bleach accelerator releasing coupler is described in Research Disclosure No. 11449, ibid. No. 24241, and Japanese Patent Provisional Publication No. 61(1986)-201247. The ligand releasing coupler is described in U.S. Pat. No. 4,553,477.

The couplers can be introduced into the photographic material by various known dispersing methods. A high-boiling solvent can be used in an oil in water dispersing method. The high-boiling solvents are described in U.S. Pat. No. 2,322,027.

The high-boiling organic solvents usually have a boiling point of not lower than 175° C. under a normal pressure. Examples of the high-boiling organic solvents include phthalic esters, phosphoric esters, phosphonic esters, benzoic esters, amides, alcohols, phenols, aliphatic carboxylic esters, aniline derivatives and hydrocarbons. Examples of the phthalic esters include dibutyl phthalate, dicyclohexyl phthalate, di-2-ethylhexyl phthalate, decyl phthalate, bis(2,4-di-t-amylphenyl)phthalate, bis(2,4-di-t-amylphenyl)isophthalate and bis(1,1-diethylpropyl)phthalate. Examples of the phosphoric esters include triphenyl phosphate, tricresyl phosphate, 2-ethylhexyldiphenyl phosphate, tricyclohexyl phosphate, tri-2-ethylhexyl phosphate, tridodecyl phosphate, tributoxyethyl phosphate, trichloropropyl phosphate and di-2-ethylhexylphenyl phosphate. Examples of the benzoic esters include 2-ethylhexyl benzoate, dodecyl benzoate and 2-ethylhexyl-p-hydroxybenzoate. Examples of the amides include N,N-diethyldodecanamide, N,N-diethyllaurylamide and N-tetradecylpyrrolidone. An example of the alcohol is isostearyl alcohol. An example of the phenol is 2,4-di-tert-amylphenol. Examples of the aliphatic carboxylic esters include bis(2-ethylhexyl)sebacate, dioctyl azelate, glycerol tributyrate, isostearyl lactate and trioctyl citrate. An example of the aniline derivative is N,N-dibutyl-2-butoxyl-5-tert-octylaniline. Examples of the hydrocarbons include paraffin, dodecylbenzene and diisopropylnaphthalene.

An organic solvent can be used as an auxiliary solvent in addition to the high-boiling organic solvent. The auxiliary solvent has a boiling point of not lower than about 30° C. The boiling point preferably is in the range of 50° to 160° C. Examples of the auxiliary solvents include ethyl acetate, butyl acetate, ethyl propionate, methyl ethyl ketone, cyclohexanone, 2-ethoxyethyl acetate and dimethylformamide.

A latex dispersing method is available in preparation of the photographic material. A process of the latex dispersing method, effects thereof and examples of latex for impregnation are described in U.S. Pat. No. 4,199,363, German Patent Publications No. 2,541,274 and No. 2,541,230.

There is no specific limitation on the support on which the above-mentioned silver halide emulsion layer is provided. Various flexible and rigid materials can be used as the support. The flexible materials include plastic films, papers and cloths. The rigid materials include glass, ceramics and metals. Preferred examples of the flexible materials include semi-synthetic or synthetic polymers, baryta papers; and other papers coated or laminated with α-olefin polymers. Examples of the semi-synthetic or synthetic polymers include cellulose nitrate, cellulose acetate, cellulose butyl acetate, polystyrene, polyvinyl chloride, polyethylene terephthalate and polycarbonate. Examples of the α-olefin polymers include polyethylene, polypropylene and ethylene-butene copolymer. The support can be colored with dyes or pigments. Further, the support can also be made black for light-blocking. The surface of the support is generally subjected to undercoating treatment to enhance the adhesion with the silver halide emulsion layer. The surface of the support may be further subjected to other various treatments such as glow discharge, corona discharge, irradiation with ultraviolet rays and flame treatment before or after the undercoating treatment.

The silver halide emulsion layer and other hydrophilic colloidal layers can be coated on the support by a known coating method such as dip coating, roller coating, flood coating and extrusion coating. Two or more layers can be simultaneously coated. The simultaneous coating methods are described in U.S. Pat. Nos. 2,681,294, 2,761,791, 3,526,528 and No. 3,508,947.

The photographic material of the invention can be used as a monochromatic or color photographic material. In more detail, the photographic material is available as a usual or cinematographic color negative film, a color reversal film for slide or television, a color paper, a color positive film, a color reversal paper, a color diffusion. The material is also available as a transfer type photographic material and a heat development type color photographic material. Further, the photographic material is available as a black and white photographic material for X-rays by using a mixture of three color couplers or by using a black coupler. The three color couplers are described in Research Disclosure, No. 17,123, (July 1978). The black coupler is described in U.S. Pat. No. 4,126,461 and British Patent No. 2,102,136. Furthermore, the photographic material is available as a printing film (e.g., lithographic films and scanner films), a medical (direct or indirect) or industrial X-ray film, a picture-taking black and white negative film, a black and white photographic paper or a COM or usual microfilm. Moreover, the material is available as a silver salt diffusion transfer type photographic material or a printing out type photographic material.

The photographic material can be used in a color diffusion transfer process. The color diffusion transfer process can be classified into a peel apart type, an integrated type and a film unit type that does not require peeling. The integrated type is described Japanese Patent Publications No. 46(1971)-16356 and No. 48(1973)-33697, Japanese Patent Provisional Publication No. 50(1975)-13040, and British Patent No. 1,330,524. The film unit type is described in Japanese Patent Provisional Publication No. 57(1982)-19345.

An acidic polymer layer protected with a neutralization timing layer can be advantageously used in the color diffusion transfer photographic material, because the layers have a function of allowing a broad latitude of the processing temperature. The acidic polymer may be added to a developing solution contained in a vessel.

Various exposure means can be employed for exposure of the photographic material of the invention. As the light source, any optional light source releasing a radiation corresponding to the sensitivity wavelength of the photographic material can be employed. Examples of the light sources generally used include natural light (sun light), incandescent lamp, halogen lamp, mercury lamp, fluorescent lamp, and flash light sources (e.g., electric flash and metal-burning flashbulb).

Light sources that emit light in the ultraviolet to infrared region can be also used as the recording light sources. For example, the photographic material can be exposed to gas lasers, dye solution lasers, semiconductor lasers, light emission diode or plasma light source. The material can be exposed to fluorescent surface given by the stimulated phosphor with electron rays (e.g., CRT). A liquid crystal (LCD) is also available. The photographic material can use an exposure means in a microshutter array is combined with a linear or plane-like light source. The microshutter array may comprise lead zirconate titanate (PLZT) doped with lanthanum. The spectral distribution used in the exposure process can be appropriately adjusted by color filters.

A color developing solution used in the development process of the photographic material according to the invention preferably is an alkaline aqueous solution containing an aromatic primary amine color developing agent as a host component. Aminophenol compounds and p-phenylenediamine compounds are preferably used as the color developing agent. Examples of the p-phenylenediamine compounds include 3-methyl-4-amino-N,N-diethylaniline, 3-methyl-4-amino-N-ethyl-N-D-hydroxyethylaniline, 3-methyl-4-amino-N-ethyl-N-β-methanesulfonamideethylaniline and 3-methyl-4-amino-N-ethyl-N-D-methoxyethylaniline. Sulfates, hydrochlorides and p-toluenesulfonates of those compounds are also available. Salts of diamines are generally preferred to free diamines because the salts are more stable than the free diamines.

The color developing solution generally contains pH buffering agents (e.g., alkali metal carbonates, borates and phosphates), development inhibitors (e.g., bromides, iodides, benzimidazoles, benzothiazoles, mercapto compounds) and antifogging agents. The developing solution may further contain preservatives (e.g., hydroxylamine, sulfite), organic solvents (e.g., triethanol amine, diethylene glycol), development accelerators (e.g., benzyl alcohol, polyethylene glycol, quarternary ammonium salts, amines), nucleus-forming agents (e.g., color-forming couplers, completing couplers and sodiumboron hydrides), development-assisting agents (e.g., 1-phenyl-3-pyrazolidone), viscosity-increasing agents, chelating agents (e.g., aminopolycarboxylic acid, aminopolyphosphonic acid, alkylphosphonic acid, phosphonocarboxylic acid) and antioxidants. The antioxidants are described in German Patent Publication No. 2,622,950.

In the development process of color reversal photographic materials, a color development is generally made after monochromatic development. A monochromic developing solution used in the monochromatic development generally contains various monochromatic developing agents such as dihydroxybenzenes (e.g., hydroquinone), 3-pyrazolidones (e.g., 1-phenyl-3-pyrazolidone), and aminophenols (e.g., N-methyl-p-aminophenol). The monochromatic developing agents can be employed singly or in combination.

The silver halide emulsion layer is generally subjected to bleaching process after the color development process. The bleaching process can be conducted simultaneously with or separately from a fixing process. For the rapid processing, a bleach-fix process can be conducted after the bleaching process. Bleaching solutions usually contain polyvalent metals such as iron(III), cobalt(III), chromium(IV) and copper(II), peracids, quinones and nitroso compounds. Examples of the bleaching agents include ferricyanides; dichromates; organic complex salts of iron(III) or cobalt(III), persulfates, manganates and nitrosophenol. Examples of the organic complex salts of iron(III) or cobalt(III) include complex salts thereof with aminopolycarboxylic acids and complex salts thereof with organic acids. Examples of the aminopolycarboxylic acids include ethylenediaminetetraacetic acid, diethylenetriaminepentaacetic acid, nitrilotriacetic acid and 1,3-diamino-2-propanoltetraacetic acid. Examples of the organic acids include citric acid, tartaric acid and malic acid. Ethylenediaminetetraacetic acid iron(III) salt, diethylenetriaminepentaacetic acid iron(III) salt and persulfate are preferred from the viewpoints of rapid processing and prevention of environmental pollution. Particularly, the ethylenediaminetetraacetic acid iron(III) complex salt is preferably used in a bleaching solution (in bleaching bath) or a bleach-fix solution.

A bleaching accelerator can be optionally used in the bleaching bath, the bleach-fix bath or the prior bath to those baths. Examples of the bleaching accelerators include mercapto or disulfide compounds, thiazolidine derivatives, thiourea derivatives, iodides, polyethylene oxides and polyamine compounds. The mercapto and disulfide compounds are described in U.S. Pat. No. 3,893,858, German Patents No. 1,290,812, No. 2,059,988, Japanese Patent Provisional Publications No. 53(1978)-32736, No. 53(1978)-57831, No. 53(1978)-37418, No. 53(1978)-65732, No. 53(1978)-72623, No. 53(1978)-95630, No. 53(1978)-95631, No. 53(1978)-104232, No. 53(1978)-124424, No. 53(1978)-141623, No. 53(1978)-28426, and Research Disclosure No. 17129 (July 1978). The thiazolidine derivatives are described in Japanese Patent Provisional Publication No. 50(1975)-140129. The thiourea derivatives are described in Japanese Patent Publication No. 45(1970)-8506, Japanese Patent Provisional Publications No. 52(1977)-20832, No. 53(1978)-32735 and U.S. Pat. No. 3,706,561. The iodides are described in German Patent No. 1,127,715 and Japanese Patent Provisional Publication No. 58(1983)-16235. The polyethylene oxides are described in German Patents No. 966,410 and No. 2,748,430. The polyamine compounds are described in Japanese Patent Publication No. 45(1970)-8836. Other bleaching accelerators are described in Japanese patent Provisional Publications No. 49(1974)-42434, No. 49(1974)-59644, No. 53(1978)-94927, NO. 54(1979)35727, NO. 55(1980)-26506 and No. 58(1983)-163940. Additionally, iodide ion and bromide ion can also be available as the bleaching accelerator. The bleaching accelerators preferably are mercapto or disulfide compounds because the compounds show high acceleration effects. The preferred compounds are described in U.S. Pat. Nos. 3,893,858, 4,552,834, German Patent Publication No. 1,290,812 and Japanese Patent Provisional Publication No. 53(1978)-95630. The bleaching accelerators may be contained in the photographic material. The bleaching accelerators are particularly effective in the bleach-fix process of color photographic materials for picture-taking.

Examples of fixing agents include thiosulfates, thiocyanates, thioether compounds, thioureas, and iodides. When iodides are used as the fixing agents, they are used in a large amount. Of the above-mentioned compounds, thiosulfates are generally used. A preservative can be used in the bleach-fix solution or the fixing solution. Examples of the preservatives include sulfites, bisulfites and carbonylbisulfurous acid addition products.

After the bleach-fix process or the fixing process, the photographic material is generally subjected to washing and stabilization. In the washing stage or the stabilization stage, a variety of known compounds can be used for preventing precipitation and saving water. For example, a hard water softening agent can be used to prevent precipitation. Examples of the agents include inorganic phosphoric acids, aminopolycarboxylic acids, organic aminopolyphosphoric acids and organic phosphoric acids. The washing or stabilizing solution may further contain germicides, mildewcides or metal salts (e.g., magnesium salts, aluminum salts and bismuth salts) to prevent various bacteria, alga and mildew. A surface active agent is also available for preventing drying strain or drying mark. Further, various hardeners for film-hardening can be used in the solution. Moreover, compounds described in L. E. West, Photographic Science And Engineering, Vol. 6, pages 344 to 359, (1955) can be also employed. Chelating agents and mildewcides are particularly preferred.

In the washing process, countercurrent washing using two or more baths is generally employed to save water. Instead of the washing process, a multi-stage countercurrent stabilizing process as described in Japanese Patent Provisional Publication No. 57(1982)-8543 can be used, and in this process, 2 to 9 countercurrent baths are required. The stabilizing baths may further contain various compounds to stabilize resulting images. For example, various buffering agents for adjusting pH value of the resulting films (for example, adjusting to pH of 3–9), and aldehydes (e.g., formalin) may be added. Concrete examples of the buffering agents include borates, metaborates, borax, phosphates, carbonates, potassium hydroxide, sodium hydroxide, ammonia water, monocarboxylic acids, dicarboxylic acids and polycarboxylic acids. They may be used in combination. Further, other additives are available. Examples of the other additives include chelating agents (e.g., inorganic phosphoric acids, aminopolycarboxylic acids, organic phosphoric acids, organic phosphonic acids, aminopolyphosphonic acids and phosphonocarboxylic acids), germicides (e.g., benzoisothiazolinone, isothiazolone, 4-thiazolinebenzimidazole, halogenated phenol, sulfanilamide and benzotriazole), surface active agents, brightening agents and hardeners. Those additives can be used in combination of two or more same kinds or different kinds.

As the pH-adjusting agents employable after the washing and stabilization processes, there can be preferably mentioned various ammonium salts such as ammonium chloride, ammonium nitrate, ammonium sulfate, ammonium phosphate, ammonium sulfite and ammonium thiosulfate.

In the use of the color photographic material for picture-taking, washing and stabilization process of one stage generally made after fixing process can be replaced with the aforementioned stabilization process and the washing process (water-saving stage). In this case, formalin used in the stabilizing bath can be omitted when the used magenta coupler has two equivalent weights.

The time required for the washing and stabilizing process depends on the kind of the photographic material or the processing conditions. The time generally is in the range of 20 seconds to 10 minutes, preferably in the range of 20 seconds to 5 minutes.

The silver halide color photographic material can contain a color developing agent for simple and rapid processing. Precursors of the color developing agents are preferably used to be contained in the photographic material. Examples of the precursors include indolenine compounds, Schiff's base type compounds, aldol compounds, metal complex salts, urethane compounds, and other salt type precursors. The indolenine compounds are described in U.S. Pat. No. 3,342,597. The Schiff's base type compounds are described in U.S. Pat. No. 3,342,599 and Research Disclosure, Nos. 14,850 and 15,159. The aldol compounds are described in Research Disclosure, No. 13,924. The metal complex salts are described in U.S. Pat. No. 3,719,492. The urethane compounds are described in Japanese Patent Provisional Publication No. 53(1978)-135628. The other salt type precursors are described in Japanese Patent Provisional Publications No. 56(1981)-6235, No. 56(1981)-16133, No. 56(1981)-59232, No. 56(1981)-67842, No. 56(1981)-83734, No. 56(1981)-83735, No. 56(1981)-83736, No. 56(1981)-89735, No. 56(1981)-81837, No. 56(1981)-54430, No. 56(1981)-106241, No. 54(1979)-107236, No. 57(1982)-97531 and No. 57(1082)-83565.

The silver halide color photographic material may contain 1-phenyl-3-pyrazolidones to accelerate color development. The 1-phenyl-3-pyrazolidones are described in Japanese Patent Provisional Publications No. 56(1981)-64339, No. 5741982)-144547, No. 57(1982)-211147, No. 58(1983)-50532, No. 58(1983)-50533, No. 58(1983)-50534, No. 58(1983)-50535, No. 58(1983)-50536 and No. 58(1083)-115438.

The processing solutions are used at a temperature of 10° to 50° C. The temperature generally is in the range of 33° to 38° C. However, the temperature can be adjusted higher to accelerate the processing or to shorten the processing time. On the other hand, it can be adjusted lower to improve qualities of the resulting images or to enhance the stability of the solutions. Cobalt intensification or hydrogen peroxide intensification can be used to save the amount of silver. The cobalt intensification is described in German Patent Publication No. 2,226,770. The hydrogen peroxide intensification is described in U.S. Pat. No. 3,674,499.

The above-mentioned various baths may be equipped with a heater, a temperature sensor, a liquid level sensor, a circulating pump, a filter, a floating lid or a squeegee.

In the continuous processing, a replenisher can be used for each processing solution to prevent the solution composition from varying, whereby a uniform finish can be obtained. The replenisher can be used in an amount of not more than half the standard amount to reduce the cost.

When the photographic material is used as a color paper, the above-mentioned bleach-fix process is usually carried out. The photographic material is used as a picture taking color photographic material, the process is optionally carried out.

EXAMPLE 1

At 75° C. 1 liter of an aqueous solution containing 0.05 g of potassium bromide and 30 g of gelatin was prepared and adjusted to pH 2 using nitric acid. To the gelatin solution, 75 ml of an aqueous solution (1M) of silver nitrate arid an aqueous solution (1M) of potassium bromide were simultaneously added while stirring over 4 minutes. The silver potential was kept at 0 mV to saturation calomel electrode.

To the resulting mixture, 675 ml of an aqueous solution (1M) of silver nitrate and an aqueous solution (1M) of potassium bromide were added over 36 minutes while keeping the silver potential at −30 mV.

After the grain formation, the resulting emulsion was desalted according to a conventional flocculation method and washed with water. Then, gelatin and water were added to the emulsion to adjust the pH and pAg values to 6.4 and 8.6, respectively.

The obtained silver bromide emulsion is a monodispersed octahedral silver bromide emulsion having a mean grain diameter of 0.25 μm and a distribution coefficient of the grain diameter of 11%.

The obtained emulsion was divided into small parts, and each part was heated to 60° C. The compounds set forth in Table 1 was added to each parts. The chemical ripening was carried out for 60 minutes.

To each part were further added 3-{3-[2-(2,4-di-tert-amylphenoxy)butylylamino]benzoylamino{-1-(2,4,6-trichlorophenyl)pyrazolone-5-one (magenta coupler), tricresyl phosphate, 4-hydroxy-6-methyl-1,3,3a,7-tetraazaindene, sodium dodecylbenzenesulfonate and 1,2-bis(vinylsulfonylacetylamino)ethane to prepare a coating solution.

The coating solution and a gelatin solution for a protective layer containing polymethyl methacrylate particles were simultaneously coated on a cellulose triacetate film support according to a pressing out method.

Each of the prepared samples was exposed to light through an optical wedge for 10 seconds, and was subjected to a developing process.

The developing process was carried out at 38° C under the following conditions.

| Process | Period (second) | Temperature |
|---|---|---|
| Color development | 165 | 38° C. |
| Bleaching | 180 | 38° C. |
| Washing | 35 | 24° C. |
| Fixing | 180 | 38° C. |
| Washing (1) | 30 | 24° C. |
| Washing (2) | 30 | 24° C. |
| Stabilizing | 30 | 38° C. |
| Drying | 260 | 55° C. |

The compositions of the processing solutions are shown below.

Color developing solution

-continued

| | |
|---|---|
| Diethylenetriaminepentaacetic acid | 1.0 g |
| 1-Hydroxyethylidene-1,1-diphosphonic acid | 3.0 g |
| Sodium sulfite | 4.0 g |
| Sodium carbonate | 30.0 g |
| Potassium bromide | 1.4 g |
| Potassium iodide | 1.5 mg |
| Hydroxylamine sulfate | 2.4 g |
| 4-(N-Ethyl-N-β-hydroxyethylamino)-2 methylaniline sulfate | 4.5 g |
| Water to make up to | 1.0 l |
| pH | 10.05 |
| Bleaching solution | |
| Iron(III) sodium ethylenediaminetetraacetate trihydrate | 100.0 g |
| Disodium ethylenediaminetetraacetate | 10.0 g |
| 3-Mercapto-1,2,4-triazole | 0.08 g |
| Ammonium bromide | 140.0 g |
| Ammonium nitrate | 30.0 g |
| Ammonia water (28%) | 6.5 ml |
| Water to make up to | 1.0 l |
| pH | 6.0 |
| Fixing solution | |
| Disodium ethylenediaminetetraacetate | 0.5 g |
| Ammonium sulfite | 20.0 g |
| Aqueous solution of ammonium thiosulfate (700 g/l) | 290.0 ml |
| Water to make up to | 1.0 l |
| pH | 6.7 |
| Stabilizing solution | |
| Sodium p-toluenesulfinate | 0.03 g |
| Polyoxyethylene-p-mononononylphenyl ether (average polymerization degree: 10) | 0.2 g |
| Disodium ethylenediaminetetraacetate | 0.05 g |
| 1,2,4-Triazole | 1.3 g |
| 1,4-Bis(1,2,4-triazole-1-ylmethyl)piperazine | 0.75 g |
| Water to make up to | 1.0 l |
| pH | 8.5 |

The densities of the processed samples were measured using a green filter. The results on the photographic properties are set forth in Table 1.

In Table 1, the sensitivity is expressed by a relative reciprocal value of the exposure required to obtain an optical density of the fogging value plus 0.2. The relative value is defined in the manner that the value of the sample No. 2 is 100. The amount of the compound means an amount by mol based on 1 mol of silver halide.

TABLE 1

| Sample No. | Compound No. | Compound Amount | Fog | Sensitivity |
|---|---|---|---|---|
| 1 | A | $1.6 \times 10^{-5}$ | 0.08 | 81 |
| 2 | A | $3.2 \times 10^{-5}$ | 0.21 | 100 |
| 3 | A | $6.4 \times 10^{-5}$ | 0.64 | 16 |
| 4 | A | $1.3 \times 10^{-4}$ | * | ** |
| 5 | B | $6.4 \times 10^{-5}$ | 0.20 | <20 |
| 6 | C | $6.4 \times 10^{-5}$ | 0.22 | <20 |
| 7 | D | $6.4 \times 10^{-5}$ | 0.21 | <20 |
| 8 | Ib-3 | $3.2 \times 10^{-5}$ | 0.06 | 82 |
| 9 | Ib-3 | $1.3 \times 10^{-4}$ | 0.14 | 102 |
| 10 | Ib-6 | $6.4 \times 10^{-5}$ | 0.15 | 110 |
| 11 | Ia-5 | $4.5 \times 10^{-5}$ | 0.16 | 100 |
| 12 | Ia-7 | $6.4 \times 10^{-5}$ | 0.18 | 95 |
| 13 | Ia-9 | $6.4 \times 10^{-5}$ | 0.31 | 108 |
| 14 | Ib-1 | $1.3 \times 10^{-4}$ | 0.16 | 102 |

TABLE 1-continued

| Sample No. | Compound No. | Compound Amount | Fog | Sensitivity |
|---|---|---|---|---|
| 15 | Ib-2 | $1.3 \times 10^{-4}$ | 0.14 | 98 |

Remark: A: N,N-dimethylselenourea (Disclosed in U.S. Patent No. 3,297,447)

B:

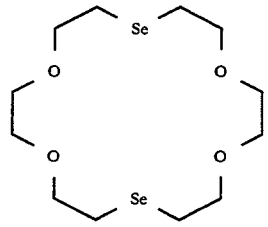

(Disclosed in U.S. Patent No. 4,782,013)

C:

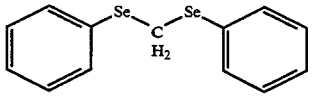

(Disclosed in U.S. Patent No. 4,111,697)

D:

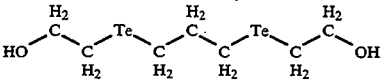

(Disclosed in Japanese Patent Provisional Publication No. 3(1991)-91735)

*: Totally fogged

**: Not measurable by fog

As is evident from the results set forth in Table 1, the selenium or tellurium sensitizers of the invention reduce the occurrence of fog, compared with the conventional sensitizers. On the other hand, the sensitivity of the sample of the invention was almost equal to or higher than that of the comparative samples.

EXAMPLE 2

To 1 l of an aqueous gelatin solution, 27.5 ml of an aqueous silver nitrate solution and 27.5 ml of an aqueous potassium bromide solution were simultaneously added at the same feed rate of 25 ml per minute while stirring according to a double jet method. The gelatin solution contained 4.5 g of potassium bromide, 7 g of gelatin having the average molecular weight of 200,000 and 0.14 ml of nitric acid. The silver nitrate solution (100 ml) contained 32 g of silver nitrate and 0.7 g of gelatin having the average molecular weight of 200,000. The potassium bromide solution (100 ml) contained 23.2 g of potassium bromide and 0.7 g of gelatin having the average molecular weight of 200,000. The temperature was adjusted at 30° C.

Further, 545 ml of an aqueous gelatin solution (gelatin: 32 g, pH: 6.5) was added to the emulsion. The emulsion was heated to 75° C. After 12 minutes, an aqueous silver nitrate solution (silver nitrate: 3.2 g) was added to the emulsion over 3 minutes. Further, 10 ml of 50 wt. % ammonium nitrate solution was added to the emulsion. The emulsion was ripened for 30 minutes.

The silver potential of the emulsion was adjusted to 70 mV using an aqueous silver nitrate solution. An aqueous silver nitrate solution and an aqueous potassium bromide solution (the same concentration) were added at the same feeding ratio for 5 minutes. Thus, a monodispersed silver bromide emulsion was prepared. The average grain size was 1.05 μm, the thickness of the grain was 0.19 μm, the aspect ratio was 5.8, and the distribution coefficient of the grain size was 10.5%.

After the grain formation, the temperature of the resulting emulsion was lowered to 35° C. The soluble salts were removed from the emulsion according to a conventional flocculation method. The emulsion was washed with water. Gelatin and water were added to the emulsion. The emulsion was adjusted to pH 6.2 and pAg 8.3, and divided into small parts. The compounds set forth in Table 2 were added to each parts of the emulsion. Further, chloroauric acid ($2.4\times10^{-5}$ mol per 1 mol of silver) and potassium thiocyanate ($4\times10^{-4}$ mol per 1 mol of silver) were added to the emulsion. The emulsion was ripened at 55° C. for 60 minutes.

Then, sodium anhydro-5,5=-dichloro-9-ethyl-3,3'-di(3-sulfopropyl)oxacarbocyaninehydroxide (sensitizing dye) and potassium iodide were added to the emulsion. Further, gelatin, 4-hydroxy-6-methyl-1,3,3a,7-tetrazaindene, polysodium styrenesulfonate, sodium dodecylbenzenesulfonate to prepare a coating solution for an emulsion layer.

A coating solution for a protective layer was prepared using gelatin, polymethyl methacrylate particles and sodium 2,4-dichloro-6-hydroxy-s-triazine. On a cellulose triacetate film support having an undercoating layer, the coating solution for an emulsion layer and the coating solution for a protective layer were simultaneously coated according to a pressing out method.

Each of the samples thus prepared was exposed to light for 1/100 second through a yellow filter and an optical wedge using a sensitometer. The samples were then developed with the following developing solution at 20° C. for 10 minutes.

Developing solution

| Developing solution | |
|---|---|
| Metol | 2.5 g |
| Ascorbic acid | 10 g |
| $Na_2B_4O_7.5H_3O$ | 35 g |
| Potassium bromide | 1 g |
| Water to make up to | 1.0 l |

After the development was stopped, the samples were fixed, washed with water and dried according to a conventional method. Then, the image densities of the samples were measured.

In Table 2, the photographic sensitivity is expressed by a relative reciprocal value of the exposure required to obtain an optical density of the fogging value plus 0.2. The relative value is defined in the manner that the value of the sample No. 20 is 100. The amount of the compound means an amount by 10−5 mol based on 1 mol of silver.

TABLE 2

| Sample No. | 20 | 21 | 22 | 23 | 24 | 25 | 26 | 27 |
|---|---|---|---|---|---|---|---|---|
| $Na_2S_2O_3$ | 2.4 | — | — | — | — | 1.6 | 1.6 | 1.6 |
| A | — | 2.4 | — | — | — | 0.8 | — | — |
| Ia-7 | — | — | 4.8 | — | — | — | — | — |
| Ib-1 | — | — | — | 3.6 | — | — | — | — |
| Ib-3 | — | — | — | — | 4.8 | — | 1.2 | 1.2 |
| Ib-6 | — | — | — | — | — | — | — | 0.8 |
| Fog | 0.04 | 0.20 | 0.16 | 0.13 | 0.16 | 0.10 | 0.09 | 0.11 |
| Sensitivity | 100 | 139 | 130 | 142 | 136 | 124 | 128 | 134 |

Remark: A: N,N-dimethylselenourea

As is evident from the results set forth in Table 2, the selenium or tellurium sensitizers of the invention reduce the occurrence of fog, compared with the conventional sensitizers. On the other hand, the sensitivity of the sample of the invention was almost equal to or higher than that of the comparative samples. Further, the selenium or tellurium sensitizers of the invention are also effective in the case that the sensitizers are used in combination with a sulfur sensitizer.

EXAMPLE 3

An aqueous silver nitrate solution and an aqueous potassium bromide solution were simultaneously added to an aqueous gelatin solution containing potassium bromide at 40° C. while stirring. The mixture was heated to 75° C. After ammonia was added to the emulsion, the emulsion was ripened and neutralized with acetic acid. An aqueous silver nitrate solution and an aqueous solution of potassium iodide, potassium bromide and $K_3IrCl_6$ ($3\times10^{-6}$ mol per 1 mol of silver) were simultaneously added to the emulsion. After an aqueous potassium iodide solution was added to the emulsion, an aqueous silver nitrate solution and aqueous potassium bromide solution were further added to the emulsion to form shell of silver halide grains.

After the addition, the emulsion was desalted according to a conventional flocculation method and washed with water. Then, gelatin and water were added to the emulsion to adjust to pH 6.3 and pAg 8.6.

Thus a tabular silver bromide emulsion was prepared. The average grain size was 1.32 μm, the thickness of the grains was 0.21 μm, the aspect ratio (average diameter per thickness) was 6.3, and the silver iodide content was 6 mol percentage.

The emulsion was divided into small parts, and each part was heated to 56° C. Then, sodium anhydro-5,5'-dichloro-9-ethyl-3,3'-di(3-sulfopropyl)oxacarbocyaninehydroxide (sensitizing dye) was added to each parts of the emulsion. Further, sodium thiosulfate ($1.2\times10^{-5}$ mol per 1 mol of silver) and the compounds set forth in Table 3 were added to the emulsion. Furthermore, chloroauric acid ($1.6\times10^{-5}$ mol per 1 mol of silver) and potassium thiocyanate ($1\times10^{-3}$ mol per 1 mol of silver) were added to the emulsion. The emulsion was ripened for 30 minutes.

To each part were added monosodium 1-(3-sulfonyl)-5-mercaptotetrazole, 3-{3-[2-(2,4-di-tert-amylphenoxy)-butylylamino]-1-(2,4,6trichlorophenyl)pyrazolone-5-one (magenta coupler), tricresyl phosphate, 4-hydroxy-6-methyl-1,3,3a,7-tetraazaindene, sodium dodecylbenzenesulfonate and 1,2-bis(vinylsulfonylacetylamino)ethane to prepare a coating solution.

The photographic material was prepared in the same manner as in Example 1 using he coating solution.

Each of the prepared samples was exposed to light through an optical wedge for 1/100 second, and was subjected to a developing process in the same manner as in Example 1. The obtained image was evaluated in the same manner as in Example 1. The results are set forth in Table 3.

In Table 3, the spectral sensitivity is expressed by a relative reciprocal value of the exposure required to obtain an optical density of the fogging value plus 0.5. The relative value is defined in the manner that the value of the sample No. 31 is 100. The amount of the compound means an amount by $10^{-5}$ mol based on 1 mol of silver.

TABLE 3

| Sample No. | 30 | 31 | 32 |
|---|---|---|---|
| A | $6.0\times10^{-6}$ | — | — |
| Ib-1 | — | $1.2\times10^{-5}$ | — |
| Ib-3 | — | — | $1.2\times10^{-5}$ |
| Ib-6 | — | — | $8.0\times10^{-6}$ |
| Fog | 0.24 | 0.18 | 0.21 |

TABLE 3-continued

| Sample No. | 30 | 31 | 32 |
|---|---|---|---|
| Sensitivity | 100 | 100 | 108 |

Remark: A: N,N-dimethylselenourea

As is evident from the results set forth in Table 3, the selenium or tellurium sensitizers of the invention reduce the occurrence of fog and improve the sensitivity, compared with the conventional sensitizer.

EXAMPLE 4

The photographic materials were prepared and evaluated in the same manner as in Example 1, except that the compounds set forth in Table 4 were used. The results are set forth in Table 4.

In Table 4, the results of the comparative samples No. to 7 of Table 1 are set forth again for reference. The meanings of the compound, fog and sensitivity are the same as those in Table 1.

TABLE 4

| Sample No. | Compound No. | Compound Amount | Fog | Sensitivity |
|---|---|---|---|---|
| 1 | A | $1.6 \times 10^{-5}$ | 0.08 | 81 |
| 2 | A | $3.2 \times 10^{-5}$ | 0.21 | 100 |
| 3 | A | $6.4 \times 10^{-5}$ | 0.64 | 16 |
| 4 | A | $1.3 \times 10^{-4}$ | * | ** |
| 5 | B | $6.4 \times 10^{-5}$ | 0.20 | <20 |
| 6 | C | $6.4 \times 10^{-5}$ | 0.22 | <20 |
| 7 | D | $6.4 \times 10^{-5}$ | 0.21 | <20 |
| 41 | II-8 | $6.4 \times 10^{-5}$ | 0.11 | 98 |
| 42 | II-9 | $1.3 \times 10^{-4}$ | 0.12 | 99 |
| 43 | II-10 | $1.3 \times 10^{-4}$ | 0.11 | 94 |

Remark: *: Totally fogged
**: Not measurable by fog

As is evident from the results set forth in Table 4, the tellurium sensitizers of the invention reduce the occurrence of fog, compared with the conventional sensitizers. On the other hand, the sensitivity of the sample of the invention was almost equal to or higher than that of the comparative samples.

EXAMPLE 5

The photographic materials were prepared and evaluated in the same manner as in Example 1, except that the compounds set forth in Table 5 were used or not used. The results are set forth in Table 5.

In Table 5, the spectral sensitivity is expressed by a relative reciprocal value of the exposure required to obtain an optical density of the fogging value plus 0.5. The relative value is defined in the manner that the value of the sample No. 51 is 100.

TABLE 5

| Sample No. | Compound No. | Compound Amount | Fog | Sensitivity |
|---|---|---|---|---|
| 51 | None | — | 0.03 | 100 |
| 52 | IIIa-3 | $6.4 \times 10^{-5}$ | 0.12 | 437 |
| 53 | IIIa-4 | $6.4 \times 10^{-5}$ | 0.08 | 392 |
| 54 | IIIa-6 | $6.4 \times 10^{-5}$ | 0.08 | 371 |
| 55 | IIIa-6 | $1.3 \times 10^{-5}$ | 0.19 | 562 |
| 56 | IVa-2 | $6.4 \times 10^{-5}$ | 0.14 | 412 |
| 57 | IVa-4 | $1.3 \times 10^{-5}$ | 0.08 | 602 |
| 58 | Va-3 | $6.4 \times 10^{-5}$ | 0.16 | 355 |
| 59 | Va-5 | $1.3 \times 10^{-4}$ | 0.08 | 542 |
| 60 | Va-9 | $4.5 \times 10^{-5}$ | 0.20 | 350 |
| 61 | Va-21 | $6.4 \times 10^{-5}$ | 0.13 | 384 |
| 62 | Va-27 | $6.4 \times 10^{-5}$ | 0.15 | 401 |
| 63 | Va-28 | $6.4 \times 10^{-5}$ | 0.14 | 364 |
| 64 | Va-30 | $6.4 \times 10^{-5}$ | 0.18 | 381 |
| 65 | Vb-2 | $6.4 \times 10^{-5}$ | 0.10 | 353 |

TABLE 5-continued

| Sample No. | Compound No. | Compound Amount | Fog | Sensitivity |
|---|---|---|---|---|
| 66 | A | $1.6 \times 10^{-5}$ | 0.08 | 521 |
| 67 | A | $3.2 \times 10^{-5}$ | 0.21 | 692 |
| 68 | A | $6.4 \times 10^{-5}$ | 0.64 | 126 |
| 69 | A | $1.3 \times 10^{-4}$ | * | ** |

Remark: A: N,N-dimethylselenourea
*: Totally fogged
**: Not measurable by fog

As is evident from the results set forth in Table 5, the selenium or tellurium sensitizers of the invention reduce the occurrence of fog, compared with the conventional sensitizers. On the other hand, the sensitivity of the sample of the invention was almost equal to that of the comparative samples.

EXAMPLE 6

The photographic materials were prepared and evaluated in the same manner as in Example 2, except that the compounds set forth in Table 6 were used. Further, the gradation of the image (gamma) was evaluated. The results are set forth in Table 6.

In Table 6, the spectral sensitivity is expressed by a relative reciprocal value of the exposure required to obtain an optical density of the fogging value plus 0.5. The relative value is defined in the manner that the value of the sample No. 70 is 100. The amount of the compound means an amount by $10^{-5}$ mol based on 1 mol of silver.

TABLE 6

| Sample No. | 70 | 71 | 72 | 73 | 74 | 75 |
|---|---|---|---|---|---|---|
| $Na_2S_2O_3$ | 2.4 | — | — | — | — | — |
| A | — | 2.4 | — | — | — | |
| IIIa-3 | — | — | 4.8 | — | — | — |
| IIIa-6 | — | — | — | 4.8 | — | — |
| IVa-2 | — | — | — | — | 3.6 | — |
| IVa-4 | — | — | — | — | 1.2 | — |
| Va-13 | — | — | — | — | — | 3.6 |
| Fog | 0.04 | 0.20 | 0.19 | 0.16 | 0.20 | 0.20 |
| Sensitivity | 100 | 139 | 109 | 118 | 134 | 130 |
| Gradation | 1.58 | 1.40 | 1.72 | 1.66 | 1.60 | 1.58 |

Remark: A: N,N-dimethylselenourea

As is evident from the results set forth in Table 6, the selenium or tellurium sensitizers of the invention reduce the occurrence of fog and improve the gradation, compared with the conventional sensitizer.

EXAMPLE 7

The photographic materials were prepared and evaluated in the same manner as in Example 3, except that the compounds set forth in Table 7 were used and the exposure time was changed from 1/100 second to 1/100,000 second. Further, the gradation of the image (gamma) was evaluated. The results are set forth in Table 7.

In Table 7, the spectral sensitivity is expressed by a relative reciprocal value of the exposure required to obtain an optical density of the fogging value plus 0.5. The relative value is defined in the manner that the value of the sample No. 80 is 100. The amount of the compound means an amount by $10^{-5}$ mol based on 1 mol of silver.

TABLE 7

| Sample No. | 80 | 81 | 82 | 83 | 84 |
|---|---|---|---|---|---|
| A | 0.6 | — | 0.4 | — | 0.4 |

TABLE 7-continued

| Sample No. | 80 | 81 | 82 | 83 | 84 |
|---|---|---|---|---|---|
| Va-13 | — | 1.2 | 0.8 | — | — |
| IIIa-4 | — | — | — | 1.2 | 1.0 |
| Fog | 0.24 | 0.21 | 0.24 | 0.22 | 0.25 |
| Sensitivity | 100 | 95 | 100 | 93 | 105 |
| Gradation | 1.15 | 1.40 | 1.28 | 1.44 | 1.32 |

Remark: A: N,N-dimethylselenourea

As is evident from the results set forth in Table 7, the selenium or tellurium sensitizers of the invention reduce the occurrence of fog and improve the gradation, compared with the conventional sensitizer.

We claim:

1. A silver halide photographic material comprising a silver halide emulsion layer provided on a support, wherein the silver halide emulsion layer contains a heterocyclic selenium or tellurium compound represented by the formula (Ia), (Ib), (Ic) or (Id):

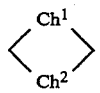

(Ia)

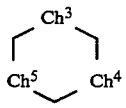

(Ib)

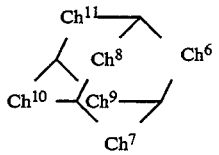

(Ic)

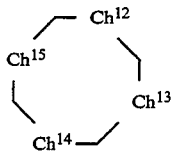

(Id)

in which each of $Ch^1$, $Ch^3$, $Ch^6$ and $Ch^{12}$ independently is Se or Te; each of $Ch^2$, $Ch^4$, $Ch^5$, $Ch^7$, $C^8$, $Ch^9$, $Ch^{10}$, $Ch^{11}$, $Ch^{13}$, $Ch^{14}$ and $Ch^{15}$ independently is O, S, Se or Te; the heterocyclic compound may have one or more substituent groups; and when the compound has two or more substituent groups, any two of the groups may be combined with each other to form a condensed heterocyclic ring.

2. The photographic material as claimed in claim 1, wherein each of $Ch^1$, $Ch^3$, $Ch^6$ and $Ch^{12}$ is Se.

3. The photographic material as claimed in claim 1, wherein each of $Ch^2$, $Ch^4$, $Ch^5$, $Ch^7$, $Ch^8$, $Ch^9$, $Ch^{10}$, $Ch^{11}$, $Ch^{13}$, $Ch^{14}$ and $Ch^{15}$ independently Se or Te.

4. The photographic material as claimed in claim 1, wherein the substituent groups of the heterocyclic rings are selected from an aliphatic group, an aromatic group, a halogen atom, a cyano group, a sulfo group, an amino group, —$Ch^{16}R^{17}$, an acyl group, a carbamoyl group, an amido group, an alkoxycarbonyl group and —$Ch^{18}COR^{19}$;

wherein $Ch^{16}$ and $Ch^{18}$ independently is O, S, Se or Te; and $R^{17}$ and $R^{19}$ independently is a hydrogen atom, an aliphatic group, an aromatic group or a heterocyclic group.

5. The photographic material as claimed in claim 4, wherein the substituent groups of the heterocyclic rings are selected from an aliphatic group, an aromatic group and an acyl group.

6. The photographic material as claimed in claim 1, wherein the silver halide emulsion layer contains the selenium or tellurium compound in an amount of $10^{-8}$ to $10^{-4}$ mol based on 1 mol of silver halide.

7. The silver halide photographic material as claimed in claim 1, wherein the heterocyclic selenium or tellurium compound is represented by formula (Ia).

8. The silver halide photographic material as claimed in claim 1, wherein the heterocyclic selenium or tellurium compound is represented by formula (Ib).

9. The silver halide photographic material as claimed in claim 1, wherein the heterocyclic selenium or tellurium compound is represented by formula (Ic).

10. The silver halide photographic material as claimed in claim 1, wherein the heterocyclic selenium or tellurium compound is represented by formula (Id).

11. A silver halide photographic material comprising a silver halide emulsion layer provided on a support, wherein the silver halide emulsion is sensitized with a heterocyclic selenium or tellurium compound represented by the formula (Ia), (Ib), (Ic) or (Id):

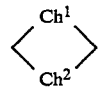

(Ia)

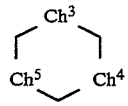

(Ib)

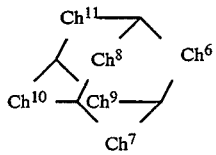

(Ic)

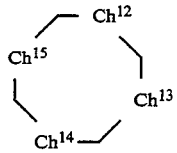

(Id)

in which each of $Ch^1$, $Ch^3$, $Ch^6$ and $Ch^{12}$ independently is Se or Te; each of $Ch^2$, $Ch^4$, $Ch^5$, $Ch^7$, $Ch^8$, $Ch^9$, $Ch^{10}$, $Ch^{11}$, $Ch^{13}$, $Ch^{14}$ and $Ch^{15}$ independently is O, S, Se or Te; the heterocyclic compound may have one or more substituent groups; and when the compound has two or more substituent groups, any two of the groups may be combined with each other to form a condensed heterocyclic ring.

12. The photographic material is claimed in claim 11, wherein the silver halide emulsion is sensitized with the selenium or tellurium compound in an amount of $10^{-8}$ to $10^{-4}$ mol based on 1 mol of silver halide.

13. The photographic material as claimed in claim 11, wherein the silver halide emulsion is sensitized with the selenium or tellurium compound at a pAg in the range of 6 to 11.

14. The photographic material as claimed in claim 11, wherein the silver halide emulsion is sensitized with the selenium or tellurium compound at a pH in the range of 3 to 10.

15. The photographic material as claimed in claim 11, wherein the silver halide emulsion is sensitized with the selenium or tellurium compound at a temperature in the range of 40° to 95° C.

16. The photographic material as claimed in claim 11, wherein the silver halide emulsion is sensitized with the selenium or tellurium compound in combination with a gold sensitizer.

17. The photographic material as claimed in claim 11, wherein the silver halide emulsion is sensitized with the selenium or tellurium compound in the presence of a silver halide solvent.

18. The silver halide photographic material as claimed in claim 11, wherein the heterocyclic selenium or tellurium compound is represented by formula (Ia).

19. The silver halide photographic material as claimed in claim 11, wherein the heterocyclic selenium or tellurium compound is represented by formula (Ib).

20. The silver halide photographic material as claimed in claim 11, wherein the heterocyclic selenium or tellurium compound is represented by formula (Ic).

21. The silver halide photographic material as claimed in claim 11, wherein the heterocyclic selenium or tellurium compound is represented by formula (Id).

22. A silver halide photographic material comprising a silver halide emulsion layer provided on a support, wherein the silver halide emulsion layer contains a tellurium compound represented by the formula (II):

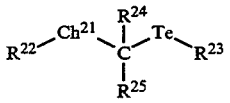

(II)

in which $Ch^{21}$ is O, S or Se; each of $R^{22}$ and $R^{23}$ independently is an aliphatic group, an aromatic group or a heterocyclic group; each of $R^{24}$ and $R^{25}$ independently is a hydrogen atom, aliphatic group, an aromatic group, a heterocyclic group, a halogen atom, a cyano group, a nitro group, a sulfo group, a sulfino group, a carboxyl group, a phosphono group, an amino group, an ammonia group, a phosphonio group, a hydrazino group, —$Ch^{26}R^{27}$, an acyl group, a carbamoyl group, an amido group, a sulfamoyl group, a sulfamido group, an aliphatic sulfonyl group, an aromatic sulfonyl group, an aliphatic sulfinyl group, an aromatic sulfinyl group, an alkoxycarbonyl group, an aryloxycarbonyl group, —$Ch^{28}COR^{29}$, an alkoxycarbonyl amino group, an aryloxycarbonylamino group or an ureido group; each of $CH^{26}$ and $Ch^{28}$ independently is O, S Se or Te; each of $R^{27}$ and $R^{29}$ independently is a hydrogen atom, an aliphatic group, an aromatic group or a heterocyclic group; each of $R^{22}$, $R^{23}$, $R^{24}$ and $R^{25}$ may have one or more substituent groups; and any two of $R^{22}$, $R^{23}$, $R^{24}$ and $R^{25}$ may be combined with each other to form a heterocyclic ring.

23. The photographic material as claimed in claim 22, wherein $Ch^{21}$ is S or Se.

24. The photographic material as claimed in claim 22, wherein each of $R^{24}$ and $R^{25}$ independently is a hydrogen atom, an aliphatic group, an aromatic group, a halogen atom, a cyano group, a sulfo group, an amino group, —$Ch^{26}R^{27}$, an acyl group, a carbamoyl group, an amido group, an alkoxycarbonyl group and —$Ch^{28}COR^{29}$;

wherein $Ch^{26}$ and $Ch^{28}$ independently is O, S, Se or Te; and $R^{27}$ and $R^{28}$ independently is a hydrogen atom, an aliphatic group, an aromatic group or a heterocyclic group.

25. The photographic material as claimed in claim 22, wherein the silver halide emulsion layer contains the tellurium compound in an amount of $10^{-8}$ to $10^{-4}$ mol based on 1 mol of silver halide.

26. A silver halide photographic material comprising a silver halide emulsion layer provided on a support, wherein the silver halide emulsion layer contains a selenium or tellurium compound represented by the formula (IIIa), (IIIb), (IVa), (IVb), (Va) or (Vb):

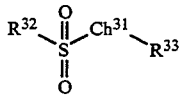

(IIIa)

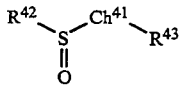

(IVa)

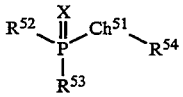

(Va)

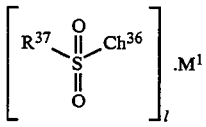

(IIIb)

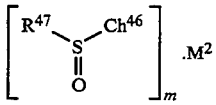

(IVb)

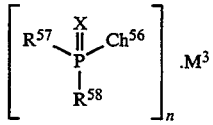

(Vb)

in which each of $Ch^{31}$, $Ch^{36}$, $Ch^{41}$, $Ch^{46}$, $Ch^{51}$ and $Ch^{56}$ independently is Se or Te; X is O or S; each of $R^{32}$, $R^{37}$, $R^{42}$, $R^{47}$, $R^{52}$, $R^{53}$, $R^{57}$ and $R^{58}$ independently is an aliphatic group, an aromatic group, a heterocyclic group, a halogen atom, an amino group or —$Ch^{61}R^{62}$; $Ch^{61}$ is O, S, Se or Te; $R^{62}$ is a hydrogen atom, an aliphatic group, an aromatic group or a heterocyclic group; each of $R^{33}$, $R^{43}$ and $R^{54}$ independently is an aliphatic group, an aromatic group, a heterocyclic group, an acyl group, a carbamoyl group, a sulfamoyl group, an aliphatic sulfonyl group, an aromatic sulfonyl group, an aliphatic sulfinyl group, an aromatic sulfinyl group, an alkoxycarbonyl group or an aryloxycarbonyl group; each of $R^{32}$, $R^{33}$, $R^{37}$, $R^{42}$, $R^{43}$, $R^{47}$, $R^{52}$, $R^{53}$, $R^{54}$, $R^{57}$ and $R^{58}$ may have one or more substituent groups; $R^{52}$ and $R^{53}$ may be combined with each other to form a heterocyclic ring; $R^{57}$ and $R^{58}$ may be combined with each other to form a heterocyclic ring; $M^1$ is an l-valent cation; $M^2$ is an m-valent cation; and $M^3$ is an n-valent cation.

27. The photographic material as claimed in claim 26, wherein each of $R^{32}$, $R^{37}$, $R^{42}$, $R^{47}$, $R^{52}$, $R^{53}$, $R^{57}$ and $R^{58}$ independently is an aliphatic group, an aromatic group or a heterocyclic group.

28. The photographic material as claimed in claim 26, wherein each of $R^{33}$, $R^{43}$ and $R^{54}$ independently is an aliphatic group, a heterocyclic group, an acyl group, carbamoyl, sulfamoyl, an aliphatic sulfonyl group, an aromatic sulfonyl group, an alkoxycarbonyl group or an aryloxycarbonyl group.

29. The photographic material as claimed in claim 26, wherein the silver halide emulsion layer contains the selenium or tellurium compound in an amount of $10^{-8}$ to $10^{-4}$ mol based on 1 mol of silver halide.

30. The silver halide photographic material as claimed in claim 26, wherein the selenium or tellurium compound is represented by formula (IIIa).

31. The silver halide photographic material as claimed in claim 26, wherein the selenium or tellurium compound is represented by formula (IIIb).

32. The silver halide photographic material as claimed in claim 26, wherein the selenium or tellurium compound is represented by formula (IVa).

33. The silver halide photographic material as claimed in claim 26, wherein the selenium or tellurium compound is represented by formula (IVb).

34. The silver halide photographic material as claimed in claim 26, wherein the selenium or tellurium compound is represented by formula (Va).

35. The silver halide photographic material as claimed in claim 26, wherein the selenium or tellurium compound is represented by formula (Vb).

* * * * *